US011261051B2

(12) United States Patent
Isobe

(10) Patent No.: US 11,261,051 B2
(45) Date of Patent: Mar. 1, 2022

(54) SHEET CONVEYANCE APPARATUS AND IMAGE FORMING APPARATUS

(71) Applicant: CANON KABUSHIKI KAISHA, Tokyo (JP)

(72) Inventor: Kenichirou Isobe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 277 days.

(21) Appl. No.: 16/587,138

(22) Filed: Sep. 30, 2019

(65) Prior Publication Data

US 2020/0122940 A1 Apr. 23, 2020

(30) Foreign Application Priority Data

Oct. 19, 2018 (JP) ..... JP2018-197899

(51) Int. Cl.
*B65H 37/04* (2006.01)
*B65H 29/14* (2006.01)

(52) U.S. Cl.
CPC ..... *B65H 37/04* (2013.01); *B65H 29/14* (2013.01); *B65H 2301/4212* (2013.01); *B65H 2402/32* (2013.01); *B65H 2402/441* (2013.01); *B65H 2402/45* (2013.01); *B65H 2403/51* (2013.01); *B65H 2405/115* (2013.01); *B65H 2405/1124* (2013.01); *B65H 2405/11151* (2013.01); *B65H 2405/324* (2013.01); *B65H 2601/11* (2013.01); *B65H 2601/111* (2013.01); *B65H 2601/321* (2013.01); *B65H 2801/27* (2013.01)

(58) Field of Classification Search
CPC ..... B65H 2402/441; B65H 2402/32; B65H 2405/15; B65H 2402/45; B65H 2601/321; B65H 2601/11; B65H 2601/111; B65H 37/04; B65H 2405/115
See application file for complete search history.

(56) References Cited

U.S. PATENT DOCUMENTS

| | | | | |
|---|---|---|---|---|
| 7,212,751 | B2 * | 5/2007 | Kayama | B65H 31/22 399/21 |
| 8,213,854 | B2 * | 7/2012 | Iida | G03G 15/6573 399/405 |
| 8,240,662 | B2 * | 8/2012 | Yahata | G03G 15/6582 271/207 |
| 10,035,676 | B2 * | 7/2018 | Shirasaki | B65H 37/04 |
| 2009/0194939 | A1 * | 8/2009 | Matsushima | G03G 15/6573 271/278 |

FOREIGN PATENT DOCUMENTS

| | | |
|---|---|---|
| JP | 2002-287447 A | 10/2002 |
| JP | 2008-292517 A | 12/2008 |
| JP | 2014-106294 A | 6/2014 |

* cited by examiner

*Primary Examiner* — Jeremy R Severson
(74) *Attorney, Agent, or Firm* — Venable LLP

(57) ABSTRACT

A sheet conveyance apparatus include a first conveyance unit, a second conveyance unit including a cover and configured to be movable between a first position where a sheet conveyed from the first conveyance unit can be conveyed to a sheet conveyance path and a second position separated from the first position, and a retaining portion configured to retain the cover at an open position and to retain the second conveyance unit at the second position through the cover retained at the open position in a case where the cover is positioned at the open position in a condition in which the second conveyance unit is positioned at the second position.

12 Claims, 31 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus and to an image forming apparatus.

Description of the Related Art

As an image forming apparatus forming an image on a sheet, there have been widely known a printer including a copier, a facsimile machine and a laser printer, a plotter, a printing machine or a multi-function printer including a plurality of functions of those apparatuses in general. Hitherto, as disclosed in Japanese Patent Application Laid-open No. 2014-106294 for example, there has been proposed what a sheet post-processing apparatus is disposed within a body of an in-body discharge type image forming apparatus and is configured to be able to be drawn out of the body by means of a sliding unit such as a rail. It is possible to readily take out a sheet jammed within the sheet post-processing apparatus disposed within the body by drawing out the sheet post-processing apparatus even if the sheet is jammed by arranging such that the sheet post-processing apparatus can be drawn out as described above.

However, if a sheet jams within the sheet post-processing apparatus as disclosed in Japanese Patent Application Laid-open No. 2014-106294, it is necessary not only to slide and move the sheet post-processing apparatus but also to open a sheet conveyance path by pivoting a cover or the like in order to remove the jammed sheet. In this case, it is desirable not only to keep the cover open but also to keep the sheet post-processing apparatus itself at a drawn-out position so that the sheet post-processing apparatus does not move from that position during a jam processing.

SUMMARY OF THE INVENTION

According to a first aspect of the invention, a sheet conveyance apparatus include a first conveyance unit configured to convey a sheet, a second conveyance unit including a cover movable between a close position in which the cover is positioned when the sheet is conveyed on a sheet conveyance path and an open position at which the cover is positioned when the sheet conveyance path is opened, the second conveyance unit being configured to be movable with respect to the first conveyance unit between a first position where the sheet conveyed from the first conveyance unit can be conveyed to the sheet conveyance path and a second position separated from the first position, and a retaining portion configured to retain the cover at the open position and to retain the second conveyance unit at the second position through the cover retained at the open position in a case where the cover is positioned at the open position in a condition in which the second conveyance unit is positioned at the second position.

Further features of the present invention will become apparent from the following description of exemplary embodiments with reference to the attached drawings.

DESCRIPTION OF THE EMBODIMENTS

A full color laser printer serving as an image forming apparatus according to embodiments of the present disclosure will be described below with reference to the drawings. Note that dimensions, materials and shapes of components and relative arrangements thereof described in the following description are not intended to limit to those claims unless specifically described. Still further, the image forming apparatus of the present disclosure is not limited only to the full color laser printer, but also may be applicable to other image forming apparatuses such as a copier, a facsimile machine and an inkjet printer. A "sheet" in the following description is a recording material including, other than a plain sheet of paper, a special sheet such as a coated sheet, a special shape sheet such as an envelope and an index sheet, a plastic film for an overhead projector and a cloth. A "document" described below is also one example of the sheet and may be a blank sheet of paper or may be what images are formed on one surface or on both surfaces here.

First Embodiment

Overall Configuration of Image Forming Apparatus

Figure 1:
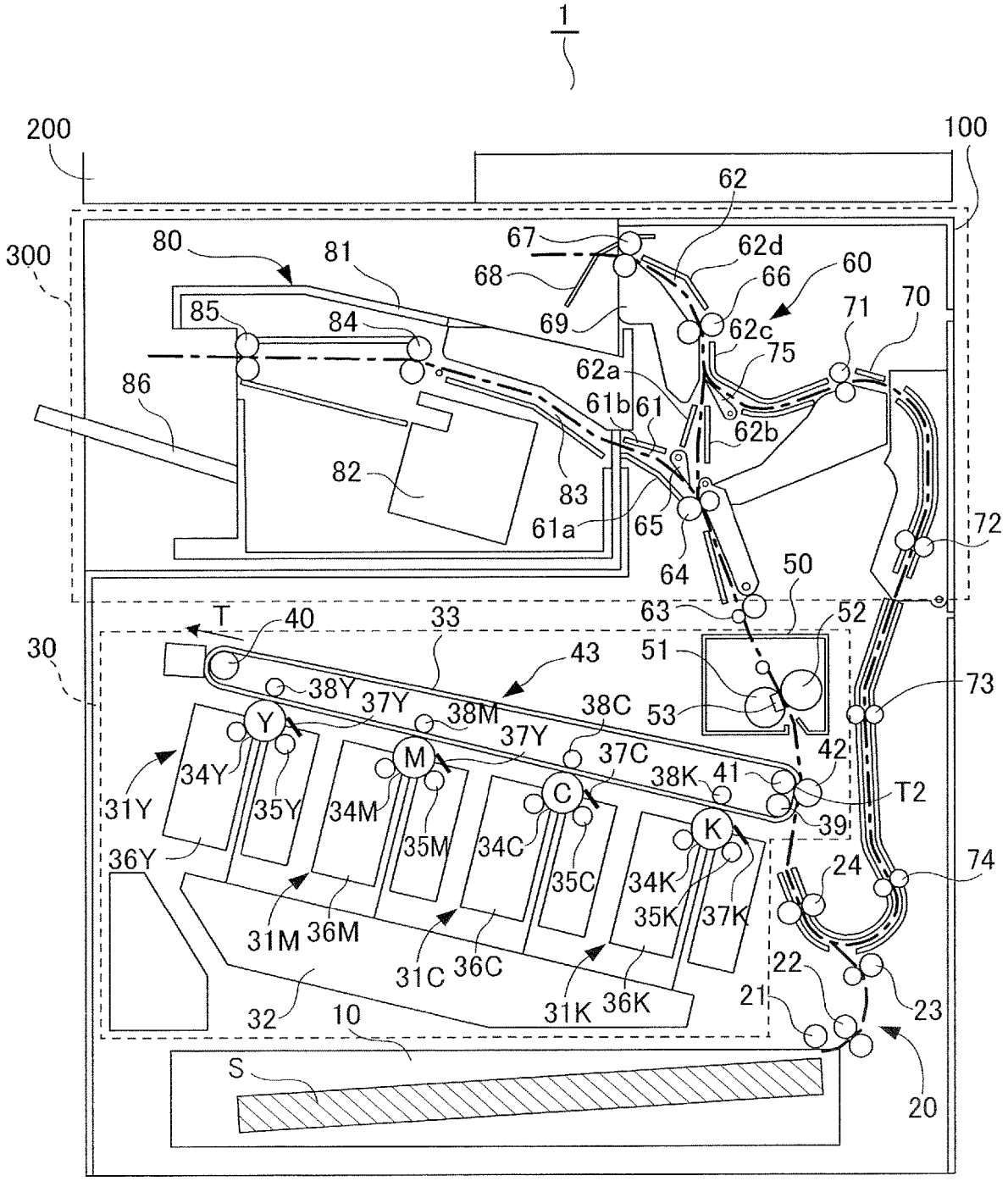
FIG. 1 is a schematic diagram illustrating a configuration of an image forming apparatus according to a first embodiment.

As illustrated in FIG. 1, the printer 1 includes an image forming apparatus body 100 and an image reading unit 200 provided above the image forming apparatus body 100 to read an image formed on a document. Provided within the image forming apparatus body 100 is a sheet cassette 10 serving as a sheet storage portion in which the sheet S on which an image is to be formed is stored and a sheet feeding unit 20 configured to feed the sheet out of the sheet cassette 10. Still further, an image forming unit 30 forming the image on the sheet fed by the sheet feeding unit 20 and a sheet discharging unit 60 discharging the sheet on which the image has been formed are provided in the image forming apparatus body 100.

The sheet stacked in the sheet cassette 10 is delivered out of the sheet cassette 10 by a pickup roller 21 of the sheet feeding unit 20 and is separated one by one by a separating roller pair 22. The sheet fed by the separating roller pair 22 is conveyed by a conveyance roller pair 23 toward a secondary transfer portion T2 of the image forming unit 30. A skew thereof is corrected by a registration roller pair 24 and the sheet is conveyed further to the secondary transfer portion T2 in synchronism with timing for forming an image.

The image forming unit 30 within the image forming apparatus body 100 includes process cartridges 31Y through 31K of yellow (Y), magenta (M), cyan (C) and black (K) disposed along an intermediate transfer belt 33. The image forming unit 30 also includes a scanner unit 32 detailed later, an intermediate transfer unit 43 and a fixing unit 50 configured to fix non-fixed toner images which have been transferred onto the sheet at the secondary transfer portion T2 to the sheet. The four process cartridges 31Y through 31K described above are provided removably to the image forming apparatus body 100 and are arrayed in order of yellow, magenta, cyan and black as described above along a rotation direction T of the intermediate transfer belt 33. These four process cartridges 31Y through 31K have approximately same structures except of that their toner colors are different. Therefore, the yellow process cartridge 31Y will be typically described and descriptions of other process cartridges will be omitted in the following description.

The process cartridge 31Y is composed of a charging roller 35Y, a developing unit 36Y, a cleaning blade 37Y and others disposed around a photosensitive drum 34Y. A surface of the photosensitive drum 34Y is homogeneously charged by the charging roller 35Y and is exposed by the scanner unit 32 based on image signals so as to form an electrostatic latent image thereon. This electrostatic latent image is developed by the developing unit 36Y as a toner image. Then, the toner image is primarily transferred onto the intermediate transfer belt 33 by a transfer voltage applied to a primary transfer roller 38Y facing the photosensitive drum 34Y while interposing the intermediate transfer belt 33 at a primary transfer portion T1.

The primary transfer portion T1 is also provided in each of the process cartridges 31M through 31K of the other colors in the same manner by disposing primary transfer rollers 38M through 38K so as to face photosensitive drums 34M through 34K, respectively. Then, a full color toner image is formed on the intermediate transfer belt 33 as the toner image of each color is sequentially superimposed and transferred onto the intermediate transfer belt 33 at each of the primary transfer portion T1. The toner left without being transferred at the primary transfer portion T1 is removed from surfaces of the photosensitive drums 34Y through 34K by the cleaning blades 37Y through 37K.

The intermediate transfer unit 43 is constituted of the intermediate transfer belt 33 being stretched around a driving roller 39, a tension roller 40 and a secondary transfer inner roller 41 disposed downstream of the primary transfer rollers 38Y through 38K in the rotation direction T of the intermediate transfer belt 33. The secondary transfer inner roller 41 forms the secondary transfer portion T2 with a secondary transfer outer roller 42 disposed so as to face the secondary transfer inner roller 41 while interposing the intermediate transfer belt 33. The toner image on the intermediate transfer belt 33 is transferred onto a sheet conveyed at the secondary transfer portion T2.

The fixing unit 50 is provided downstream in the sheet conveyance direction of the secondary transfer portion T2 and constitutes a fixing nip by a heating roller 51 and a pressure roller 52 that is rotated in pressure contact with the heating roller 51. The heating roller 51 is heated up by a heater 53, e.g., a halogen lump or an induction heating device. The non-fixed toner image transferred onto the sheet at the secondary transfer portion T2 described above is heated and pressed at the fixing nip to be fixed onto the sheet.

The sheet discharging unit 60 is disposed downstream in the sheet conveyance path of the fixing unit 50, and discharges the sheet onto which the toner image has been fixed by the fixing unit 50 out of the image forming apparatus body 100. More specifically, the sheet discharging unit 60 is constituted of the sheet conveyance path branched as first and second conveyance paths 61 and 62. The sheet on which the toner image has been fixed by the fixing unit 50 is conveyed by conveyance roller pairs 63 and 64 and is guided and is switched by a distribution guide member 65, at a branch portion of the first and second conveyance paths 61 and 62, to be guided to the first conveyance path 61 or the second conveyance path 62. The sheet guided to the first conveyance path 61 is conveyed to a post-processing apparatus 80 serving as a sheet processing apparatus described in detail later. The sheet guided to the second conveyance path 62 is conveyed by a conveyance roller pair 66 and is discharged by a sheet discharge roller pair 67 onto a sheet discharge tray 81 provided at an upper surface of the post-processing apparatus 80. Note that the sheet conveyance path including the first and second conveyance paths 61 and 62 is defined such that a space through which the sheet is conveyed is parted from other spaces by disposing conveyance guides on both sides or one side thereof within the image forming apparatus body 100. For instance, the first conveyance path 61 is defined by disposing a conveyance guide 61*a* on one side thereof and disposing a conveyance guide 61*b* on the other side. The second conveyance path 62 is defined by disposing conveyance guides 62*a* and 69 on one side and disposing conveyance guides 62*b*, 62*c* and 62*d* on the other side thereof.

Still further, the discharge roller pair 67 and the conveyance roller pair 66 are configured to be normally and inversely rotatable and a reverse conveyance path 70 is branched from the second conveyance path 62. Therefore, in a case of forming images on both surfaces of the sheet, the sheet on which the image has been formed on one surface thereof is guided to the second conveyance path 62 and is conveyed by the normally rotating conveyance roller pairs 66 and 67 until when a trailing edge of the sheet is conveyed beyond the branch portion with the reverse conveyance path 70. Then, when the trailing edge of the sheet is conveyed beyond the branch portion with the reverse conveyance path 70, the conveyance roller pairs 66 and 67 rotate inversely, so that the sheet is switched back. At this time, the distribution guide member 75 is switched to a position of guiding the sheet to the reverse conveyance path 70, and the sheet switched back is conveyed to the reverse conveyance path 70 while switching back its leading and trailing edges. After that, the sheet is conveyed by conveyance roller pairs 71 through 74 within the reverse conveyance path 70 and is conveyed again to the registration roller pair 24 in a condition in which a front surface and a back surface thereof is reversed.

In the printer 1 constructed as described above, the sheet conveyance unit conveying the sheet in the upper part of the image forming unit 30 may be referred to as a first conveyance unit 300. That is, the printer 1 includes the first conveyance unit 300 constituted of a part including the sheet discharging unit 60 described above and a part defining an in-body space in which the post-processing apparatus 80 is disposed within the image forming apparatus body 100.

Configuration of Post-Processing Apparatus

Next, a configuration of the post-processing apparatus 80 serving as a second conveyance unit to which the sheet is conveyed from the first conveyance unit 300 described above will be described. The post-processing apparatus 80 is disposed within the in-body space defined between the image forming apparatus body 100 and the image reading unit 200 and is positioned at a position above the image forming unit 30 where a part thereof overlaps with the image forming unit 30 when viewed in a perpendicular direction. The post-processing apparatus 80 is provided with the abovementioned sheet discharge tray 81 formed on an upper surface thereof and is also provided therein with a post-processing portion 82, e.g., a stapler in the present embodiment, for processing the sheet. The sheet received into the post-processing apparatus 80 through the first conveyance path 61 is conveyed by a conveyance roller 84 through a sheet conveyance path 83 within the post-processing apparatus 80. After that, the sheet is processed by the post-processing portion 82 and is discharged by a discharge roller pair 85 onto a sheet discharge tray 86 on a side of the post-processing apparatus 80. When no process is to be performed on the sheet, the sheet may be discharged onto the sheet discharge tray 86 without performing post-processing by the post-processing portion 82. Note that an amount of the sheets discharged onto the sheet discharge tray 81 defined on the upper surface of the post-processing apparatus 80 is detected by a full load detecting flag 68.

Figure 2A:
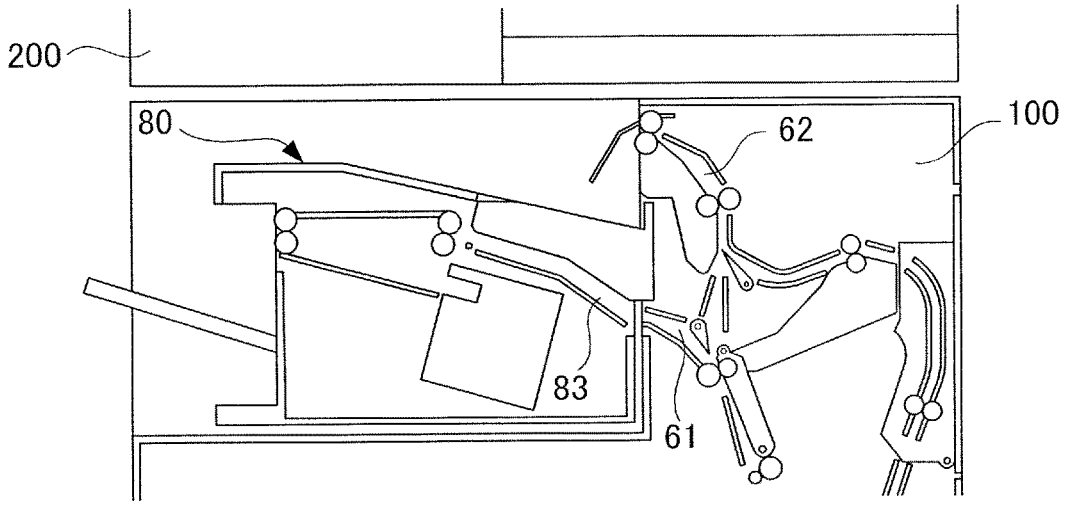
FIG. 2A illustrates a post-processing apparatus located at an operating position.
Figure 2B:
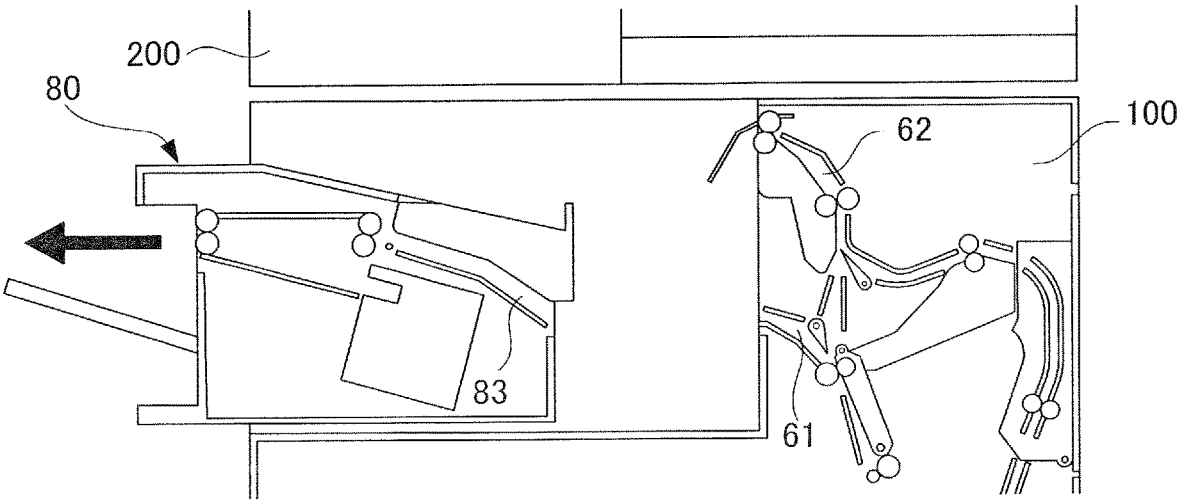
FIG. 2B illustrates the post-processing apparatus at a jam processing position.

In addition, the post-processing apparatus 80 is configured to be able to slide between an operating position, i.e., a first position as illustrated in FIG. 2A, and a jam processing position, i.e., a second position as illustrated in FIG. 2B, along a rail unit not illustrated and provided on the image forming apparatus body 100. This operating position is the first position where a communicating portion of the first conveyance path 61 of the image forming apparatus body 100 is connected with a receiving portion of the sheet conveyance path 83 of the post-processing apparatus 80, and the sheet conveyed from the first conveyance unit 300 can be conveyed to the sheet conveyance path 83 of the post-processing apparatus 80. The jam processing position is the second position separated away from the first position. The sheet conveyance path 83 of the post-processing apparatus 80 is separated away from the communicating portion of the first conveyance path 61 at this jam processing position.

Figure 3A:
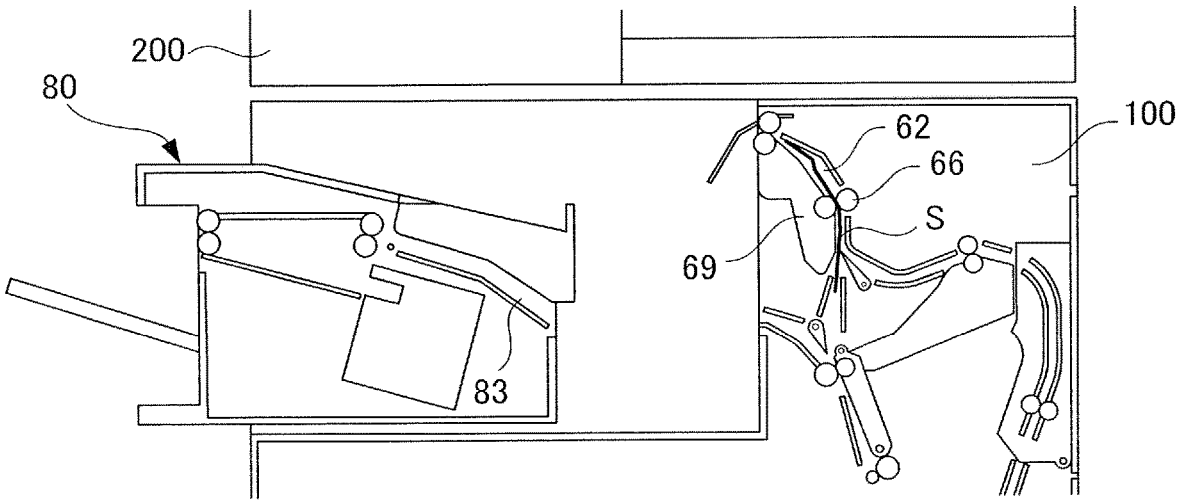
FIG. 3A illustrates a conveyance guide unit on a body side of the image forming apparatus being closed.
Figure 3B:
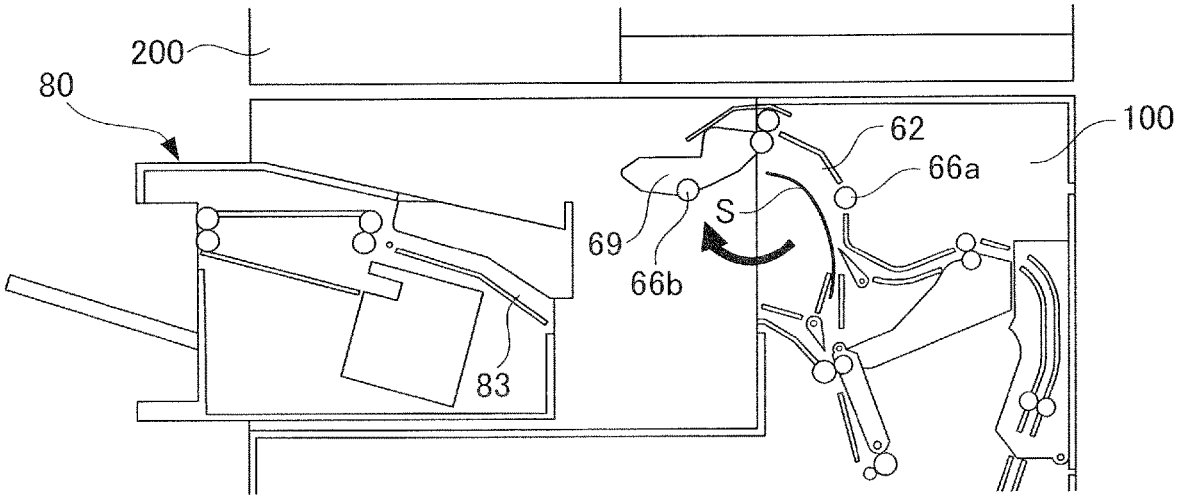
FIG. 3B illustrates the conveyance guide unit on the body side of the image forming apparatus being opened.
Figure 4:
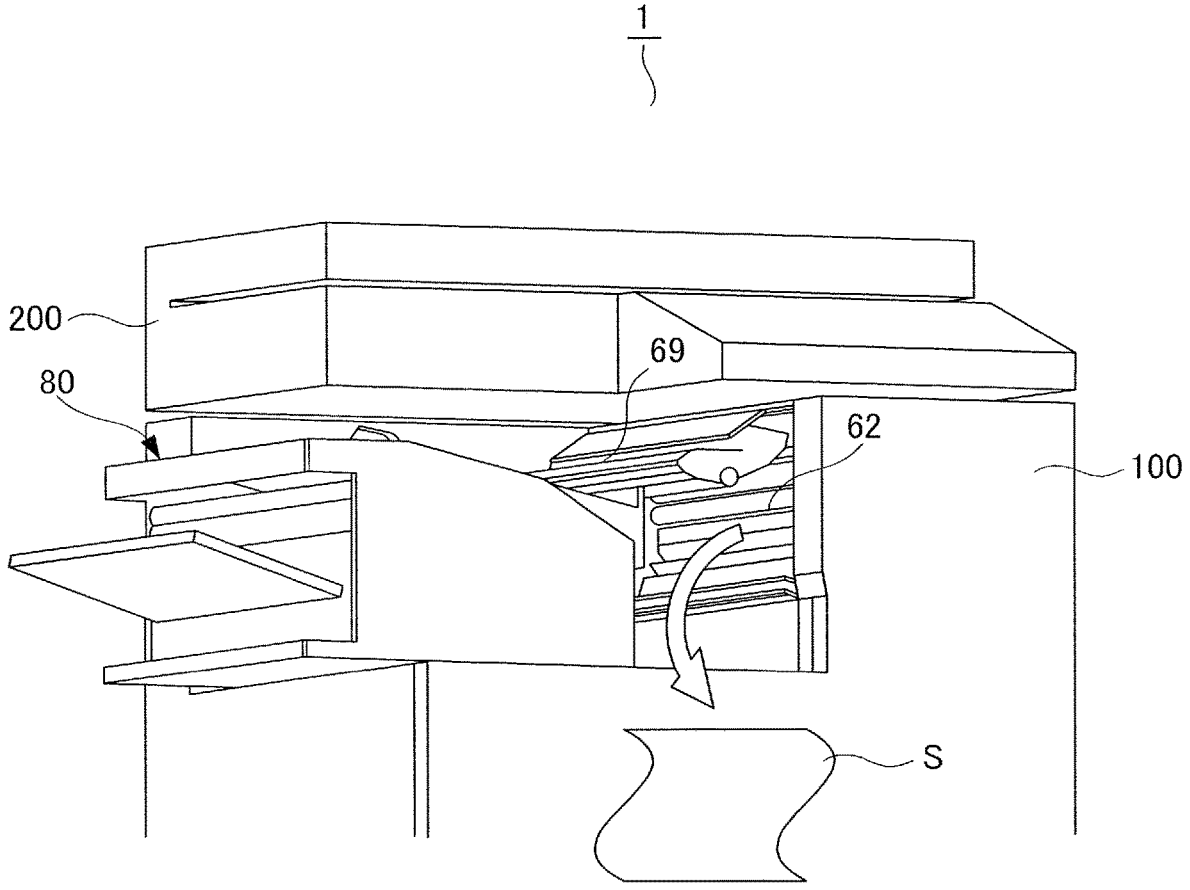
FIG. 4 illustrates a jam processing method on the body side of the image forming apparatus.

For instance, in a case where the sheet is jammed (referred to also a "jam" hereinafter) on the second conveyance path 62 of the image forming apparatus body 100, the post-processing apparatus 80 is drawn out to the abovementioned jam processing position as illustrated in FIG. 3A. Then, the conveyance guide unit 69 constituting of a surface on a side of the in-body space of the second conveyance path 62 is pivoted as illustrated in FIG. 3B to expose the second conveyance path 62 in the in-body space. More specifically, the conveyance guide unit 69 includes a conveyance guide composing one of the second conveyance path 62 and one roller 66*b* of the conveyance roller pair 66. Then, the second conveyance path 62 is opened as the conveyance guide unit 69 is turned in a direction in which one roller 66*b* of the conveyance roller pair 66 separates away from the other roller 66*a*. Thereby, an operator is enabled to access the second conveyance path 62 and to remove the sheet S jammed in the second conveyance path 62 as illustrated in FIG. 4.

Figure 5A:
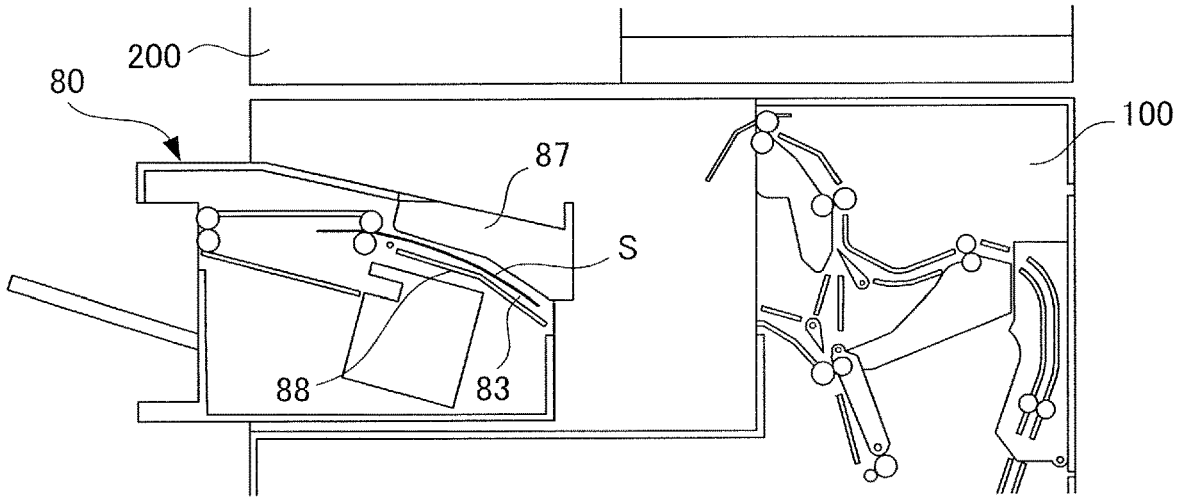
FIG. 5A illustrates a cover of the post-processing apparatus being closed.
Figure 5B:
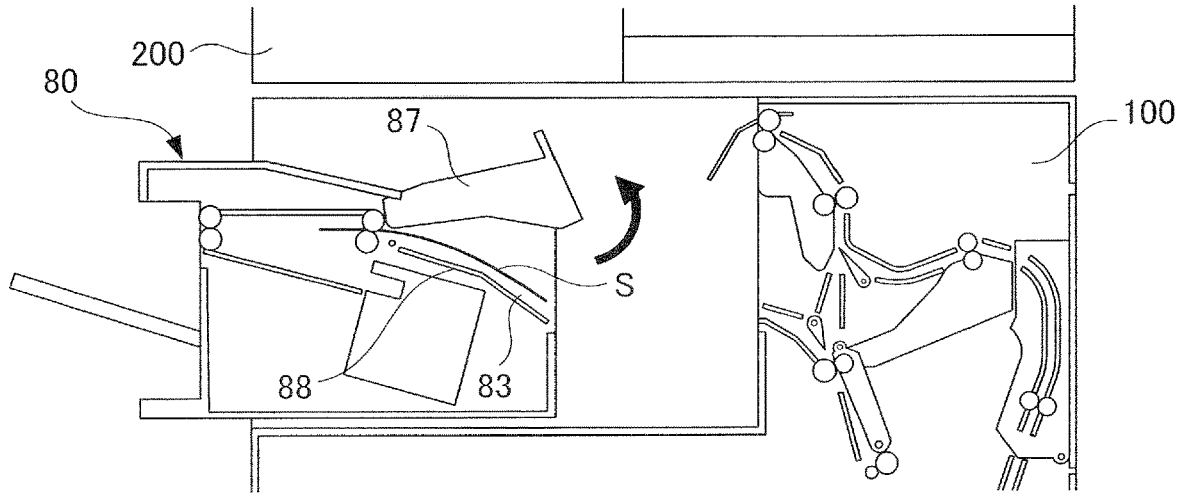
FIG. 5B illustrates the cover of the post-processing apparatus being opened.
Figure 6:
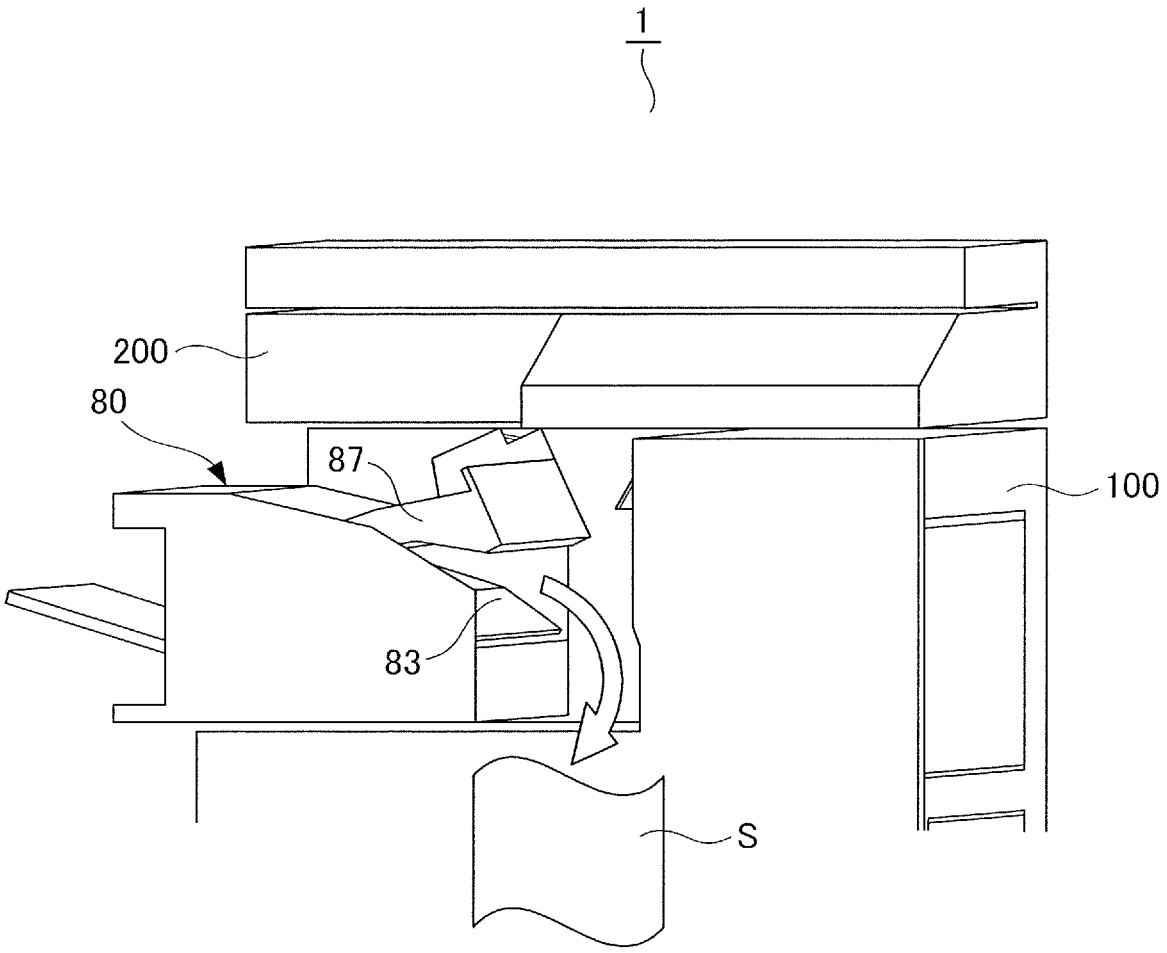
FIG. 6 illustrates a jam processing method of the post-processing apparatus.

The post-processing apparatus 80 is drawn out to the jam processing position (see FIG. 5A) also in a case where the sheet S is jammed in the sheet conveyance path within the post-processing apparatus 80. Here, the post-processing apparatus 80 is arranged to be able to open the sheet conveyance path 83 therein by pivoting an upper cover 87 on a side of the operating position of the post-processing apparatus 80. More specifically, the cover 87 is composed of a conveyance guide unit composing one side, i.e., an upper side, of the sheet conveyance path of the post-processing apparatus 80. Then, the sheet conveyance path 83 is opened by pivoting the cover 87, i.e., the conveyance guide unit, in a direction of separated away from another conveyance guide 88 after when the post-processing apparatus 80 is positioned at the jam processing position. This arrangement makes it possible for the operator to access within the sheet conveyance path 83 and to remove the sheet S jammed in the sheet conveyance path 83 as illustrated in FIG. 6.

In the present embodiment, the post-processing apparatus 80 constitutes a sheet conveyance apparatus conveying the sheet together the image forming apparatus body 100 and a retaining mechanism 90 (see FIG. 10A) serving as a retaining portion described later. In this case, the post-processing apparatus 80 is the conveyance unit movable between the first position, i.e., the operating position, and the second position, i.e., the jam processing position separated from the first position, with respect to the image forming apparatus body 100 serving as an apparatus body. The cover 87 described above is also arranged to be movable between a close position during which the sheet is conveyed through the sheet conveyance path and an open position when the sheet conveyance path 83 is opened.

Note that while the cover 87 is constituted of the pivotable conveyance guide unit composing the upper conveyance guide of the sheet conveyance path 83, the present disclosure is not limited to such configuration. For instance, the conveyance guides constituting the sheet conveyance path may be configured to be pivotable and a cover covering the conveyance guide outside thereof may be provided to use this cover as a cover of the invention. In this case, the conveyance guide becomes an inner cover. That is, the cover may be a cover covering the sheet conveyance path 83 of the post-processing apparatus 80 in the present embodiment.

Retaining Mechanism

Figure 7A:
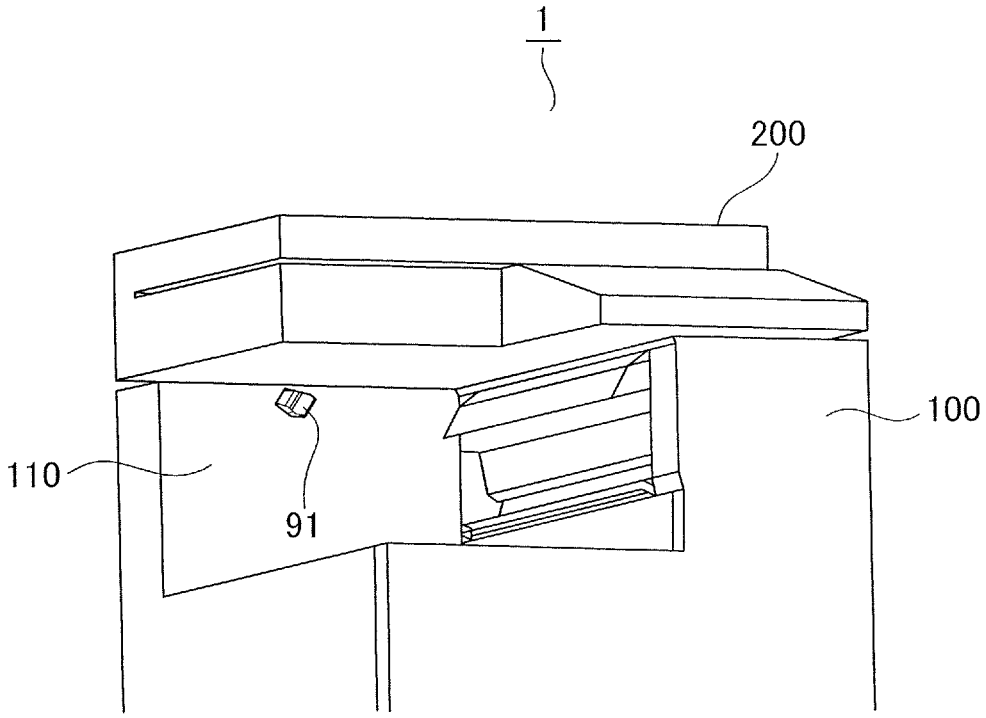
FIG. 7A illustrates a slide cam.
Figure 7B:
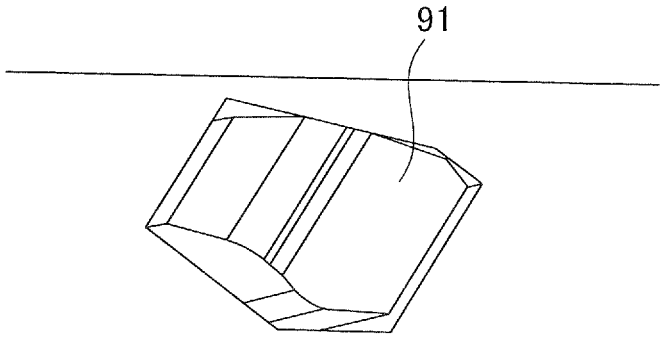
FIG. 7B is an enlarged view of the slide cam.

Next, a retaining mechanism 90 serving as a retaining portion configured to retain positions of the post-processing apparatus 80 and the cover 87 will be described with reference to FIGS. 7A through 16. In the present embodiment, the retaining mechanism 90 includes a slide cam 91, an urging member 92 and a retaining shaft 93. The retaining mechanism 90 is configured so as to retain the positions of the cover 87 and the post-processing apparatus 80 by engaging the retaining shaft 93 provided on the side of the post-processing apparatus with the slide cam 91 provided on the side of the image forming apparatus body 100. More specifically, as illustrated in FIGS. 7A and 7B, the slide cam 91 constituting a part of the retaining mechanism 90 is provided on a side surface 110, i.e., a wall surface, of the image forming apparatus body 100 facing the post-processing apparatus 80 within the in-body space.

Figure 8A:
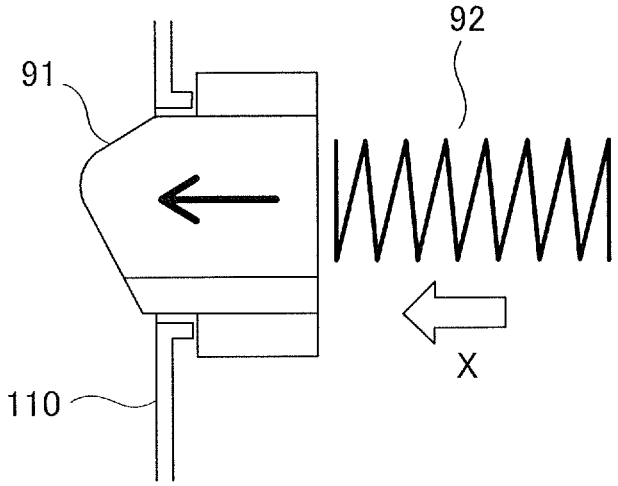
FIG. 8A illustrates the slide cam being projected by being pressed by an urging member.
Figure 8B:
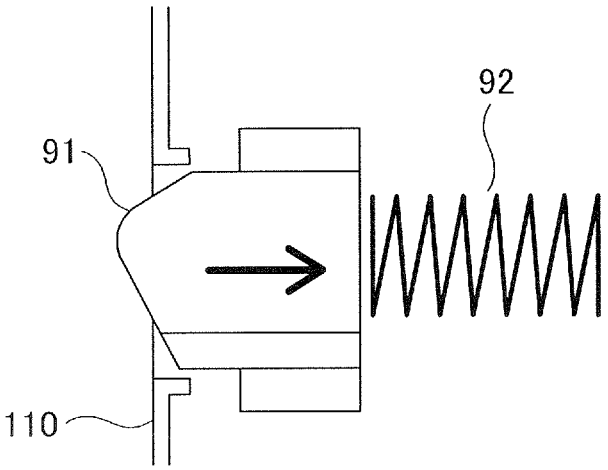
FIG. 8B illustrates the slide cam being pressed by resisting against an urging force of the urging member.

As illustrated in FIGS. 8A and 8B, the slide cam 91 is configured to slide and move in and out of the side surface 110 and is urged by an urging member 92 such that the slide cam 91 stands by and is kept at a most projecting position from the side surface 110 (see FIG. 8A). It is noted that in the present embodiment, while the urging member 92 is composed of a spring that urges the slide cam 91 in a front-back direction of the printer 1 orthogonal to the moving direction of the post-processing apparatus 80, the urging member 92 may be composed of rubber or the like for example. That is, the urging member 92 may be composed of an elastic member that can apply an urging force to the slide cam 91, such as the spring and rubber.

Figure 9A:
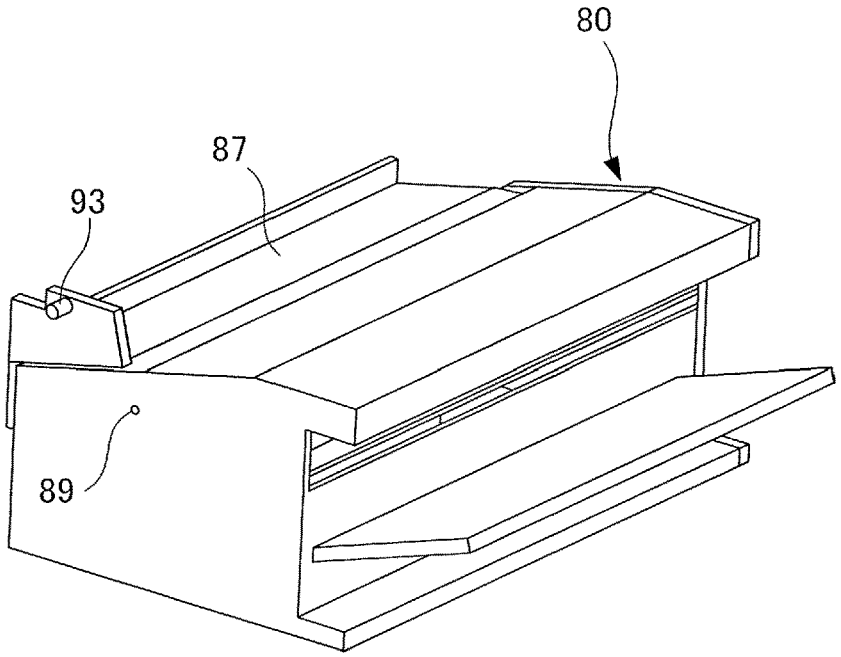
FIG. 9A illustrates a retaining shaft provided through the cover of the post-processing apparatus.
Figure 9B:
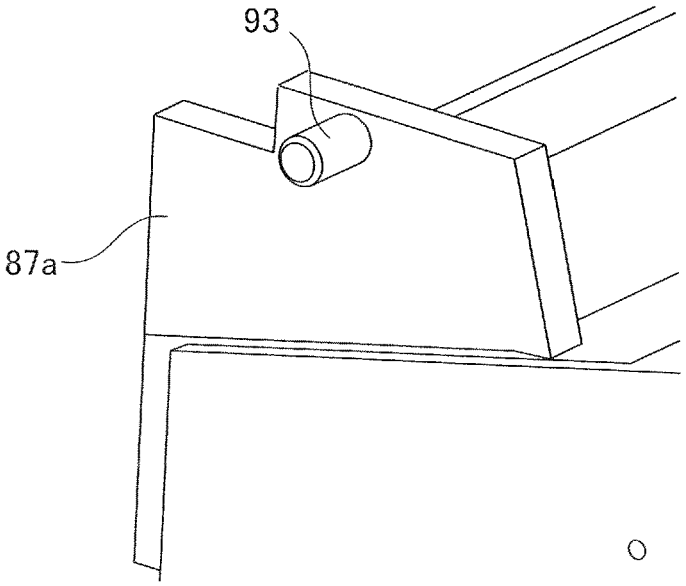
FIG. 9B is an enlarged view of the retaining shaft.

Still further, as illustrated in FIGS. 9A and 9B, the post-processing apparatus 80 is provided with the retaining shaft 93 serving as an abutment member configured to abut with the slide cam 91 on a side surface 87*a* of the cover 87 facing the side surface 110 on which the slide cam 91 is provided. The retaining shaft 93 is provided above the pivot shaft 89 of the cover 87 and is configured to move together with opening/closing motions of the cover 87. Note that in the present embodiment, the slide cam 91 constitutes a first engage portion provided in the image forming apparatus body 100 and the retaining shaft 93 constitutes a second engage portion provided in the post-processing apparatus 80 and engaging with the first engage portion.

Figure 10A:
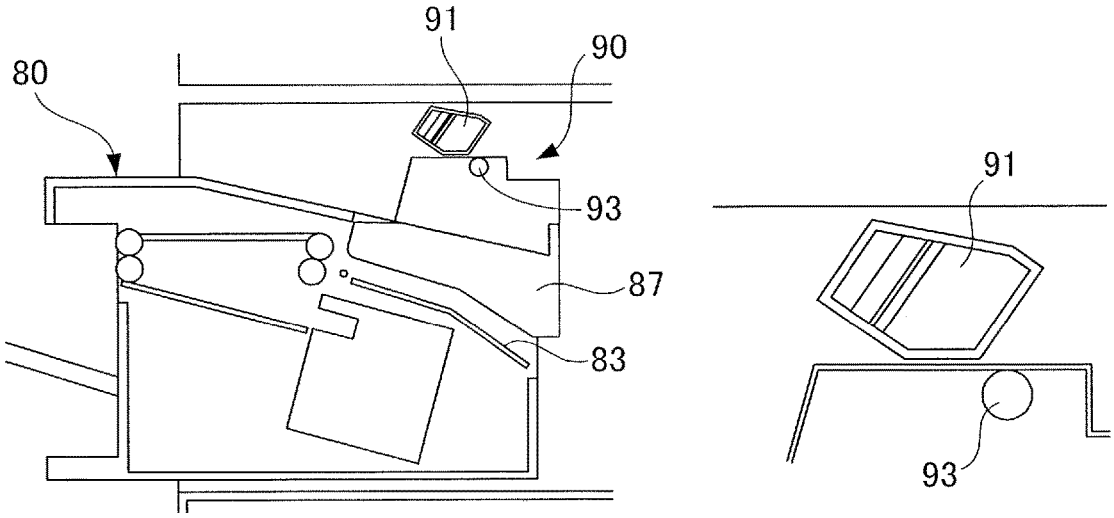
FIG. 10A illustrates a relationship between the retaining shaft and the slide cam when the cover is closed.
Figure 10B:
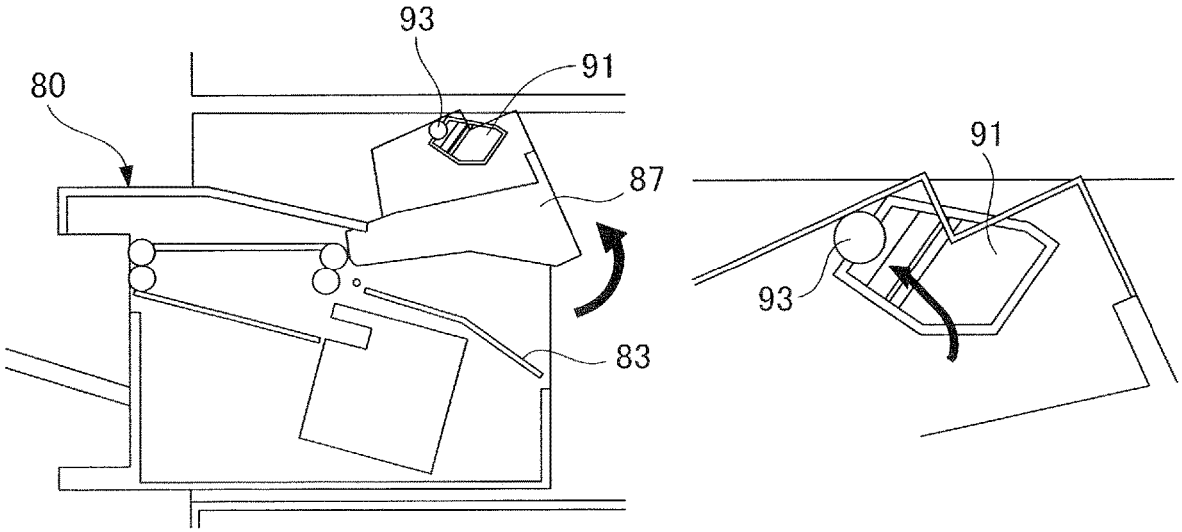
FIG. 10B illustrates the relationship between the retaining shaft and the slide cam when the cover is opened.
Figure 11A:
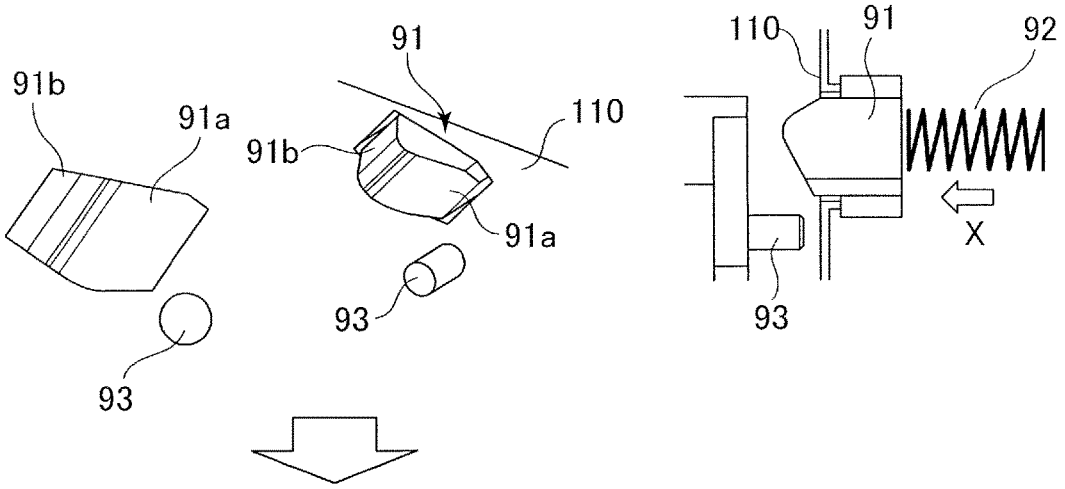
FIG. 11A illustrates motions of the slide cam and the retaining shaft when the cover is closed.
Figure 11B:
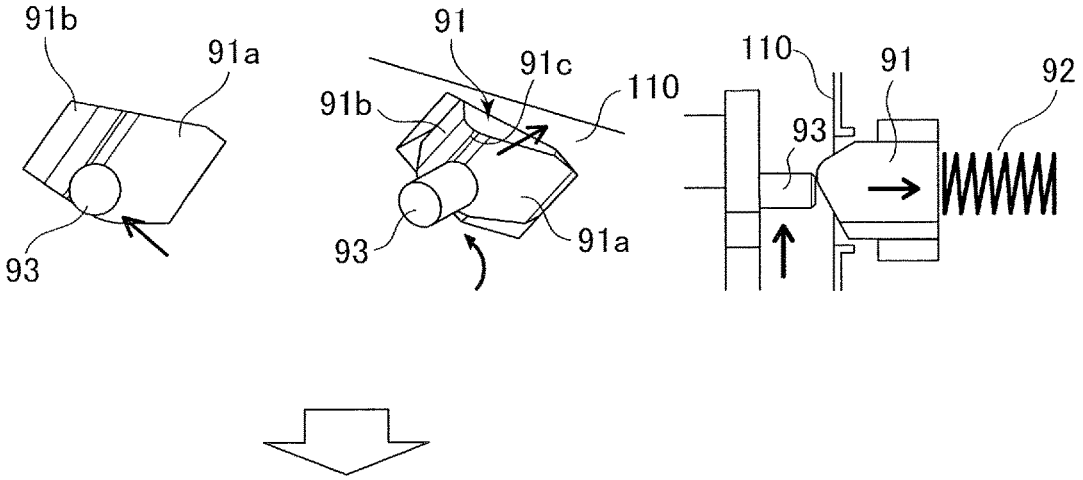
FIG. 11B illustrates motions of the slide cam and the retaining shaft on a way of opening the cover.
Figure 11C:
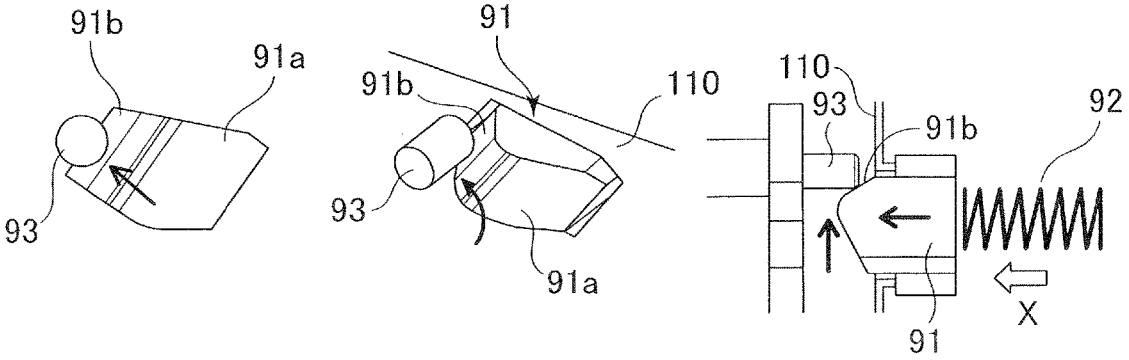
FIG. 11C illustrates motions of the slide cam and the retaining shaft when the cover is opened.

If the cover 87 is to be opened from a close position as illustrated in FIG. 10A to open position as illustrated in FIG. 10B in the condition in which the post-processing apparatus 80 is positioned at the jam processing position, the retaining shaft 93 moves to a position of riding on a cam surface of the slide cam 91 on a way of the pivot. FIGS. 11A through 11C illustrate motions of the slide cam 91 and the retaining shaft 93 at this time. In a process of pivoting the cover 87 from the close position as illustrated in FIG. 11A, the retaining shaft 93 abuts first against a slope 91*a* of the slide cam 91 (see FIG. 11B). The slope 91*a* is an upstream slope 91*a* is an upstream slope provided upstream in an opening direction of the cover 87 from the close position and is inclined so as to project toward the post-processing apparatus 80 as the inclination advances downstream in the opening direction. Along with the pivot of the cover 87, the retaining shaft 93 moves while abutting with the upstream slope 91*a* and while pushing the slide cam 91 into the image forming apparatus body 100 by resisting against an urging force X of the urging member 92. At this time, the post-processing apparatus 80 moves while receiving a resistance from the slide cam 91.

Then, when the retaining shaft 93 passes through an edge 91*c* of the slide cam 91 and comes to a downstream slope 91*b*, the slide cam 91 returns to the original standby retaining position by the urging force X of the urging member 92. Here, the slide cam 91 is inclined in the back direction so as to be distant away from the post-processing apparatus 80 as the inclination advances downstream in the opening direction opposite to that of the upstream slope 91*a*. When the cover 87 is opened completely to the open position where the operator can access the sheet conveyance path 83, a part of the retaining shaft 93 takes a position of riding on the slope 91*b* of the slide cam 91, so that the cover 87 is kept at the open position as the standby retaining position.

More specifically, as illustrated in FIG. 11C, the downstream slope 91*b* described above is inclined such that an upstream side of the downstream slope 91*b* is positioned upward of the downstream side of the downstream slope 91*b* in a second direction in which the post-processing apparatus 80 moves from the operating position to the jam processing position. Then, when the cover 87 comes to the open position in the condition in which the post-processing apparatus 80 is located at the jam processing position, the downstream slope 91*b* is positioned upstream, in the second moving direction in which the post-processing apparatus 80 moves from the jam processing position to the operating position, of the retaining shaft 93 and abuts with the retaining shaft 93 from downward.

At this time, in the condition in which the cover 87 is pivoted to the position completely and manually opened, the slide cam 91 is urged by an enough urging force that does not move the cover 87 to the close position by own weight of the cover 87 beyond the slide cam 91. Therefore, the cover 87 can be retained at the open position and the operator can remove the sheet jammed in the sheet conveyance path 83 while leaving his hand from the cover 87.

Still further, the slide cam 91 is urged by an enough urging force that enables to keep the retained condition of the post-processing apparatus 80 when the sheet S jammed in a condition of being nipped by the roller pairs 84 and 85 within the post-processing apparatus 80 is pulled out while resisting against a nip force. Therefore, even if the post-processing apparatus 80 tries to move from the jam processing position toward the operating position, it is possible to apply an adequate resistance against a moving force thereof and to remove the sheet S within the post-processing apparatus 80 without moving the post-processing apparatus 80 located at the jam processing position.

Figure 12A:
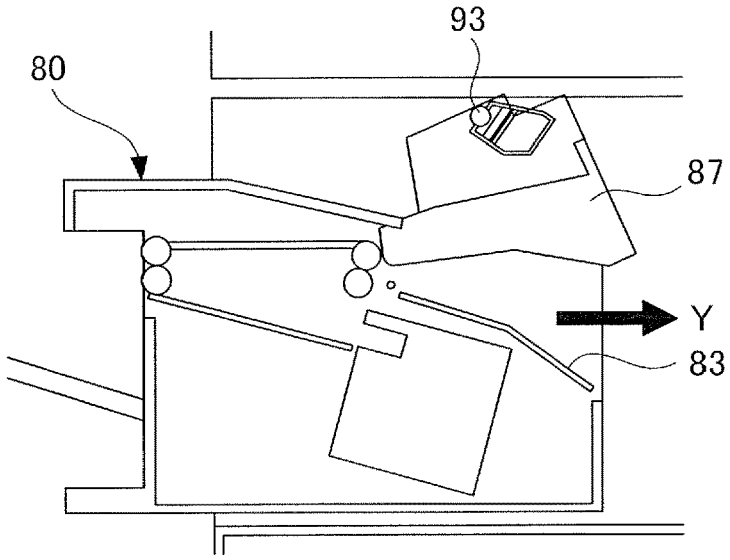
FIG. 12A illustrates the post-processing apparatus located at the jam processing position while opening the cover.
Figure 12B:
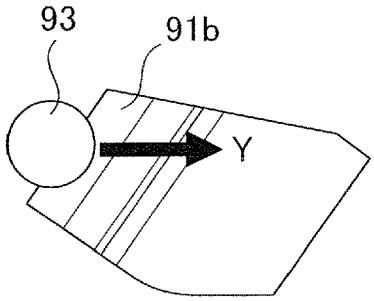
FIG. 12B illustrates a relationship between the retaining shaft and the slide cam in the condition in FIG. 12A.
Figure 12C:
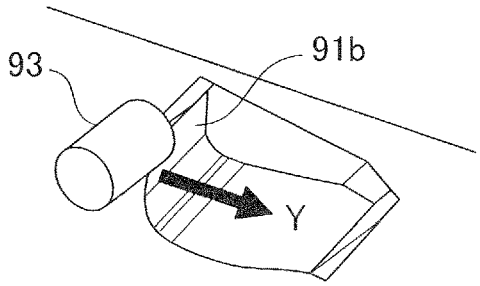
FIG. 12C is a perspective view illustrating the retaining shaft and the slide cam in FIG. 12B.
Figure 13A:
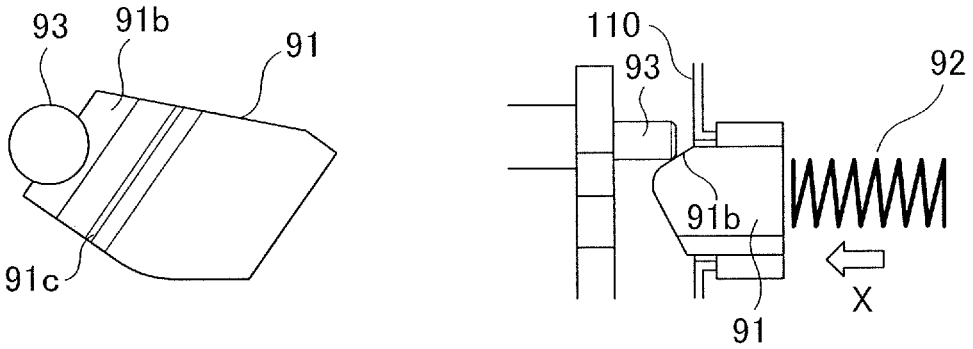
FIG. 13A illustrates the motions of the slide cam and the retaining shaft in the condition in FIG. 12A.
Figure 13B:
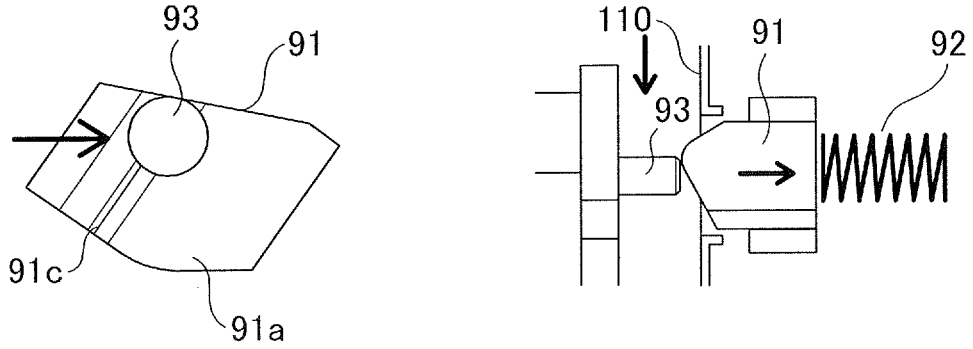
FIG. 13B illustrates the motions of the slide cam and the retaining shaft when the post-processing apparatus moves from the position in FIG. 13A to an operating position.

In addition to that, as illustrated in FIGS. 12A through 12C, if the post-processing apparatus 80 is tried to move from the jam processing position to the operating position in the condition in which the cover 87 is opened and the retaining shaft 93 abuts with the downstream slope 91*b*, the retaining shaft 93 also slides and moves in a Y direction together with the post-processing apparatus 80. If the retaining shaft 93 slides and moves from this position, the retaining shaft 93 moves while abutting with the downstream slope 91*b* and the slide cam 91 slides and moves into the image forming apparatus body 100 by resisting against the urging force X of the urging member 92 as illustrated in FIGS. 13A through 13C.

That is, if the post-processing apparatus 80 is moved in the first moving direction from the jam processing position to the operating position in the condition in which the cover 87 is retained at the open position by the retaining mechanism 90, the retaining shaft 93 is displaced while resisting against the urging force of the urging member 92, i.e., an elastic force of an elastic member. Thus, a resistance is applied to the post-processing apparatus 80 by this arrangement. In other words, the downstream slope 91*b* of the slide cam 91 constitutes a support portion supporting the retaining shaft 93 from downward in terms of the gravity direction. In the same time, the downstream slope 91*b* constitutes a resistance applying portion applying the resistance to the post-processing apparatus 80 by abutting with the retaining shaft 93 when the post-processing apparatus 80 moves from the jam processing position to the operating position. Note that although the support portion and the resistance applying portion are formed of one member in the present embodiment, they may be formed respectively by different members.

Figure 13C:
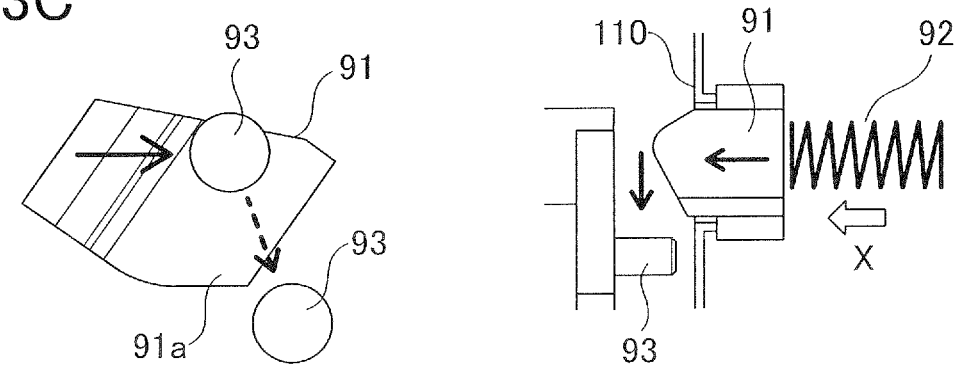
FIG. 13C illustrates the motions of the slide cam and the retaining shaft when the post-processing apparatus moves from the position in FIG. 13B to the operating position.

When the retaining shaft 93 goes beyond the edge 91*c* of the slide cam 91 as illustrated in FIG. 13C, nothing supports the retaining shaft 93, so that the cover 87 returns from the open position to the close position by its own weight. In the same time, the slide cam 91 returns to the original standby and retaining position by the urging force X of the urging member 92.

Figure 14A:
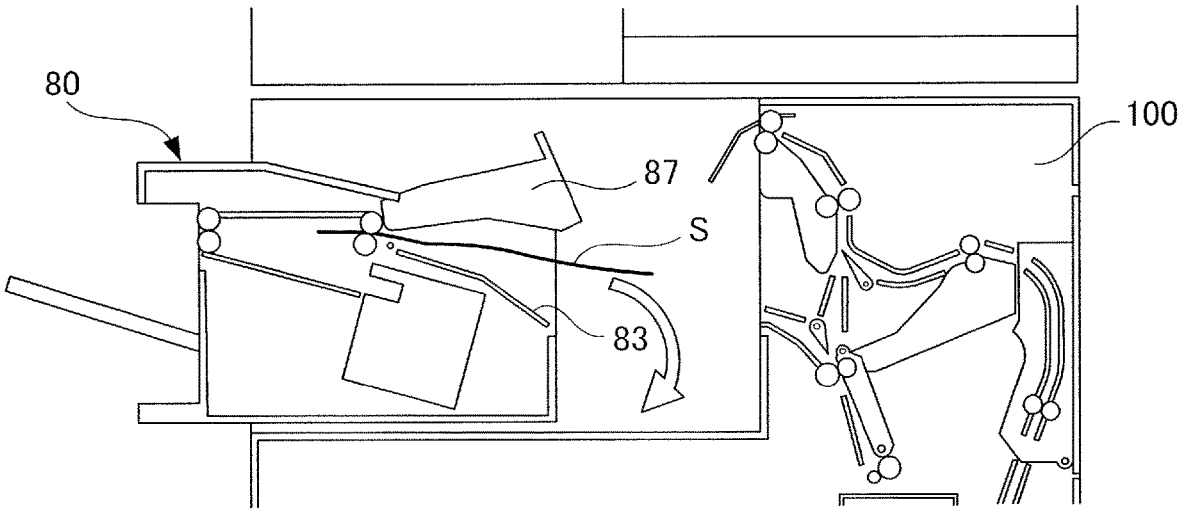
FIG. 14A illustrates the post-processing apparatus in a condition in taking out a jammed sheet.
Figure 14B:
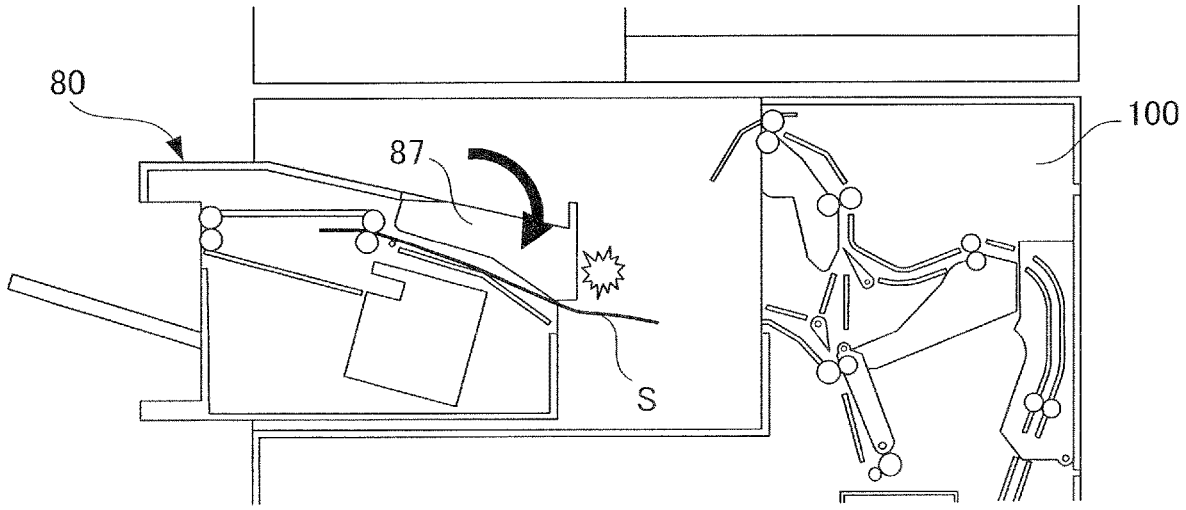
FIG. 14B illustrates a case where the cover is closed in processing the jam.
Figure 15A:
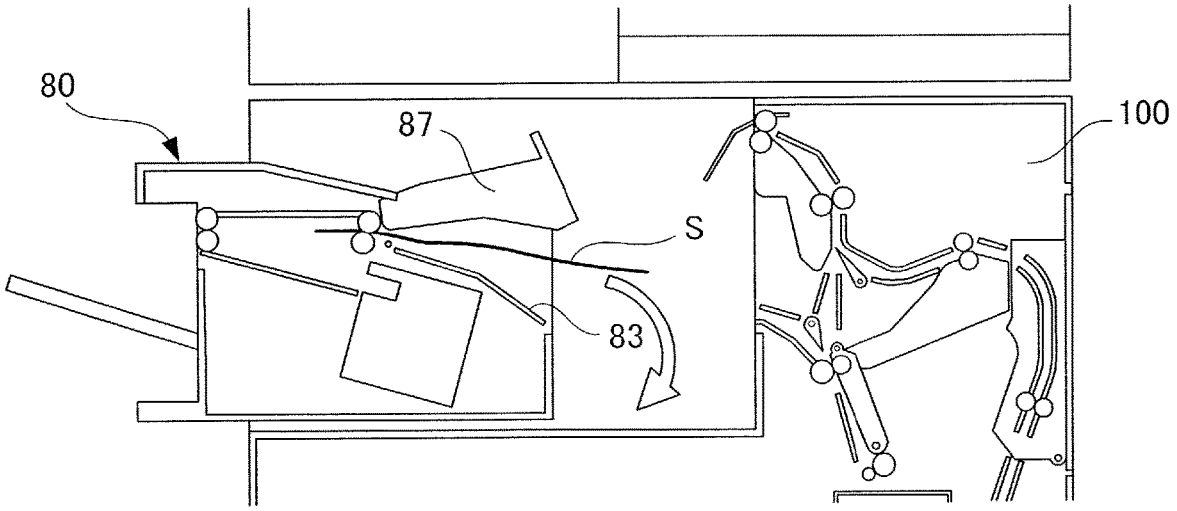
FIG. 15A illustrates the post-processing apparatus in a condition of taking out the jammed sheet.
Figure 15B:
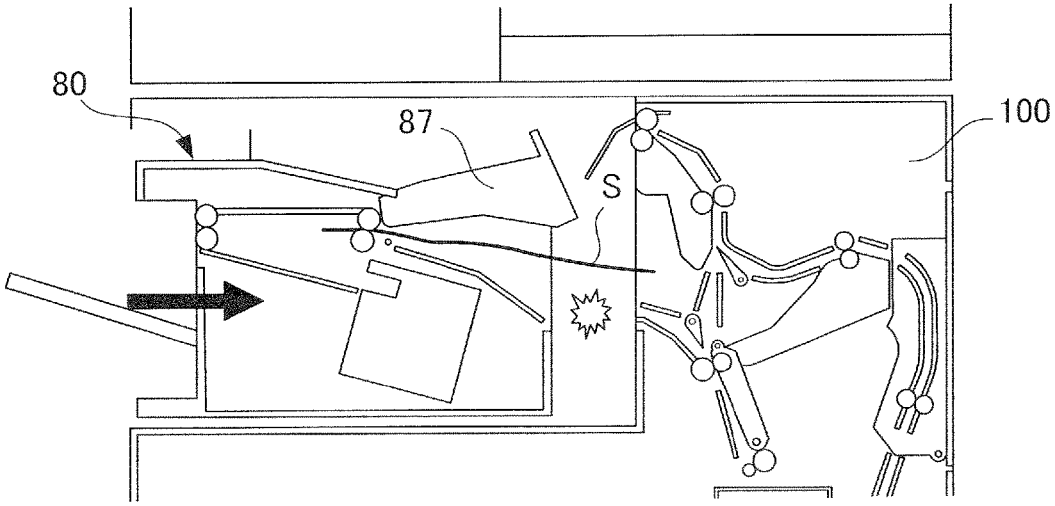
FIG. 15B illustrates a case where the post-processing apparatus moves in processing the jam.

As described above, it becomes possible to remove the sheet jammed inside while releasing a hand off by providing the retaining mechanism 90 in the configuration in which operations of the two different movable members, e.g., the post-processing apparatus 80 and the cover 87, are required to access the jammed sheet. Therefore, no such happening that the cover 87 erroneously drops onto the operating position and thus catches the hand occurs in removing the sheet within the post-processing apparatus 80 as illustrated in FIGS. 14A and 14B. Still further, no such happening that the post-processing apparatus 80 erroneously moves in the direction of the operating position and thus catches the hand occurs in removing the sheet within the post-processing apparatus 80 as illustrated in FIGS. 15A and 15B.

Still further, because the retaining mechanism 90 is arranged to retain the post-processing apparatus 80 at the jam processing position through the cover 87 retained at the open position, it is possible to retain the two movable portions by one retaining portion. Accordingly, it is possible to retain the cover 87 and the post-processing apparatus 80 respectively at the open position and the jam processing position by operating one retaining portion, and those movable members can be retained simply with small man-hours. Still further, their mechanism can be simple and can be constructed less expensively. That is, it is not necessary to provide respective retaining mechanisms for retaining positions of the cover and the post-processing apparatus described above, so that the cost can be cut and man-hours required in operating the retaining mechanisms can be cut.

Figure 16A:
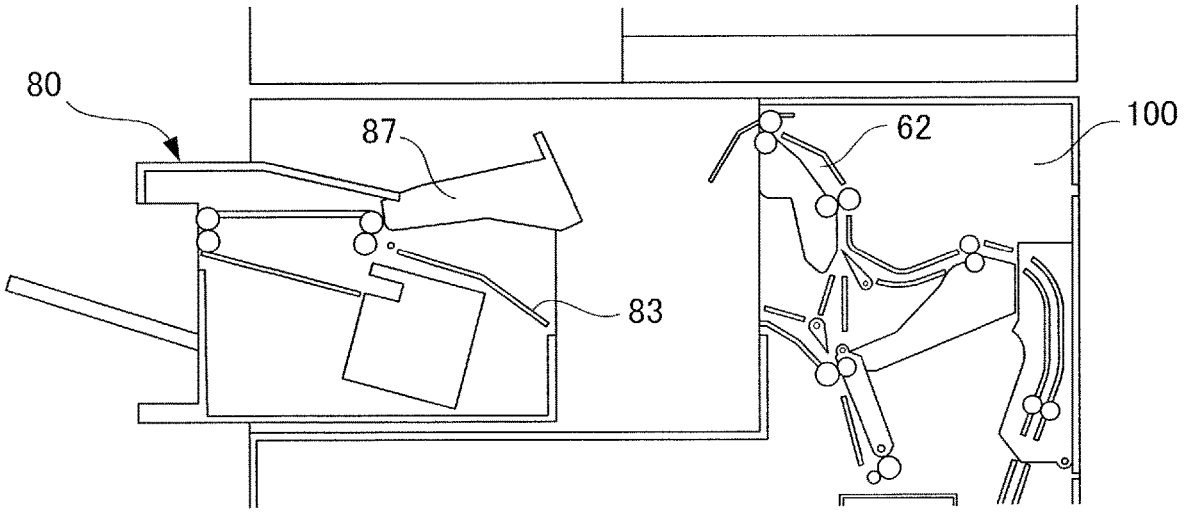
FIG. 16A illustrates the post-processing apparatus located at the jam processing position.
Figure 16B:
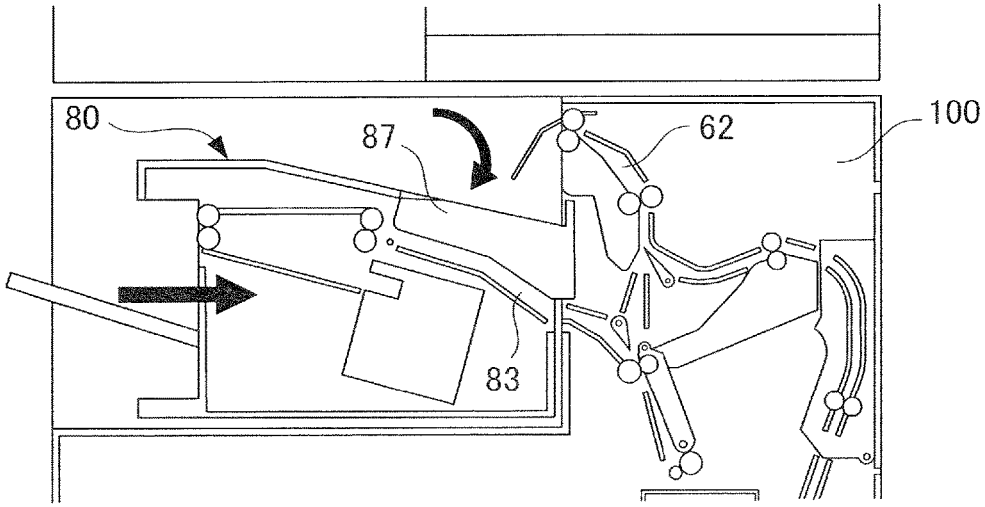
FIG. 16B illustrates a motion of the post-processing apparatus in returning from the jam processing position to the operating position.

Still further, as illustrated in FIGS. 16A and 16B, it is possible to return the cover 87 to the close position by sliding and moving the post-processing apparatus 80 from the jam processing position to the operating position while keeping the cover 87 at the open position after opening the cover 87 and removing the sheet within the post-processing apparatus 80. That is, the retaining mechanism 90 is arranged to be able to release the retainment of the cover 87 and the post-processing apparatus 80 based on a predetermined distance by which the post-processing apparatus 80 at the jam processing position is moved toward the operating position. Due to that, the operator can return the apparatus to an operable condition by one operation after the jam processing work.

Note that according to the present embodiment, the retaining mechanism 90 is arranged so as not retain the post-processing apparatus 80 at the jam processing position even if the post-processing apparatus 80 is positioned at the jam processing position in a condition in which the cover 87 is in the close position.

Second Embodiment

Next, a second embodiment of the present disclosure will be described with reference to FIGS. 17A through 23B. Note that the second embodiment is different from the first embodiment in that the retaining mechanism is consisted of a recess defined on the side surface 110 of the image forming apparatus body 100 and a projecting portion defined on the cover of the post-processing apparatus 80. Therefore, the same components with those of the first embodiment will be denoted by the same reference numerals and a description thereof will be omitted.

Figure 17A:
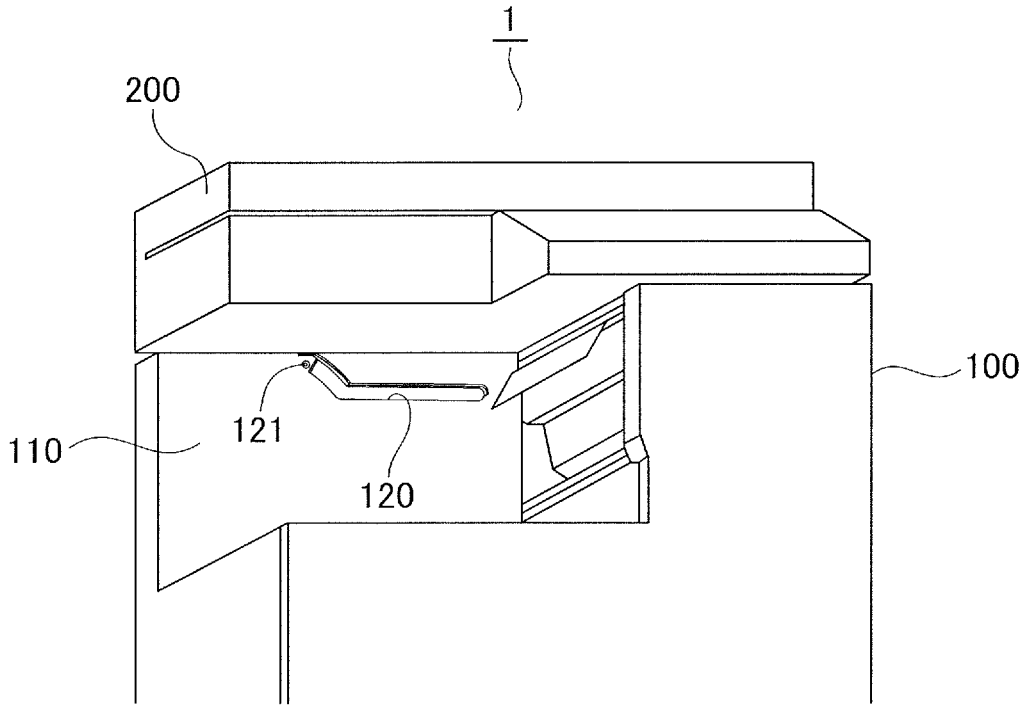
FIG. 17A illustrates an image forming apparatus according to a second embodiment.
Figure 17B:
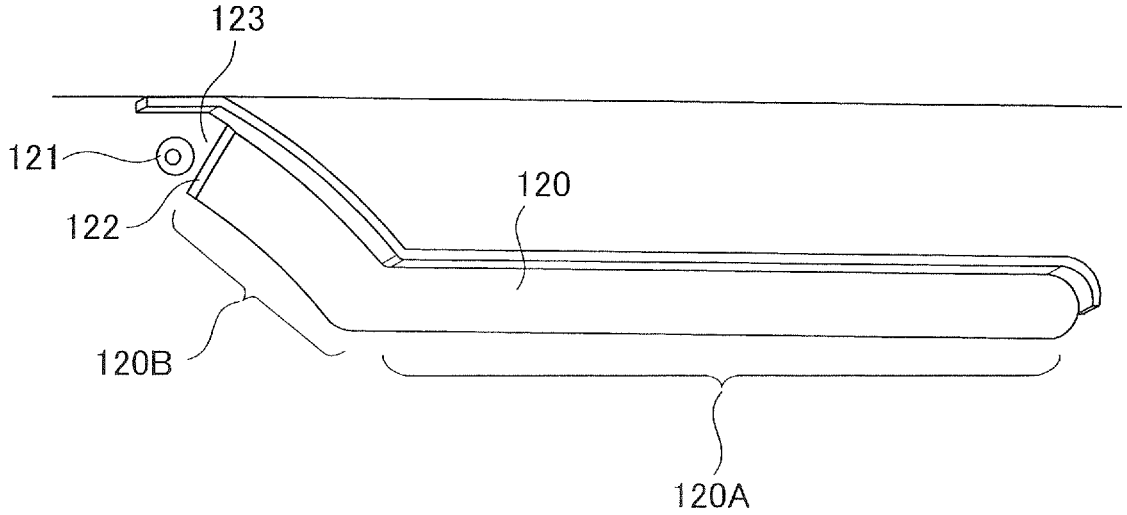
FIG. 17B illustrates a groove and retaining hole.

As illustrated in FIGS. 17A and 17B, a groove 120 and a retaining hole 121 are defined on the side surface 110 of the image forming apparatus body 100 of the printer 1. The groove 120 includes a straight area 120A extending straightly along the sliding and moving direction of the post-processing apparatus 80 and an arcuate area 120B defined continuously from the straight area 120A and bent arcuately upward. It is noted that the straight area is also called as a horizontal area. The retaining hole 121 is disposed just ahead of a slope 122 at an end of the arcuate area 120B. More specifically, the retaining hole 121 is defined downstream of the groove 120 in the second moving direction from the operating position to the jam processing position of the post-processing apparatus 80, and a parting portion 123 is provided between the retaining hole 121 and the groove 120 such that the retaining hole 121 is discontinuously defined from the groove 120.

Figure 18A:
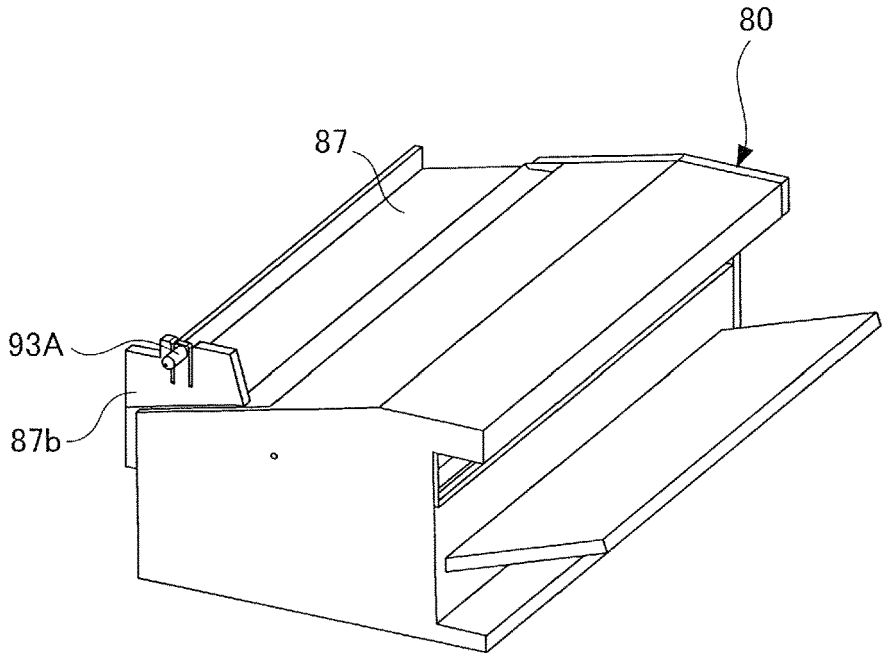
FIG. 18A illustrates the post-processing apparatus of the second embodiment.
Figure 18B:
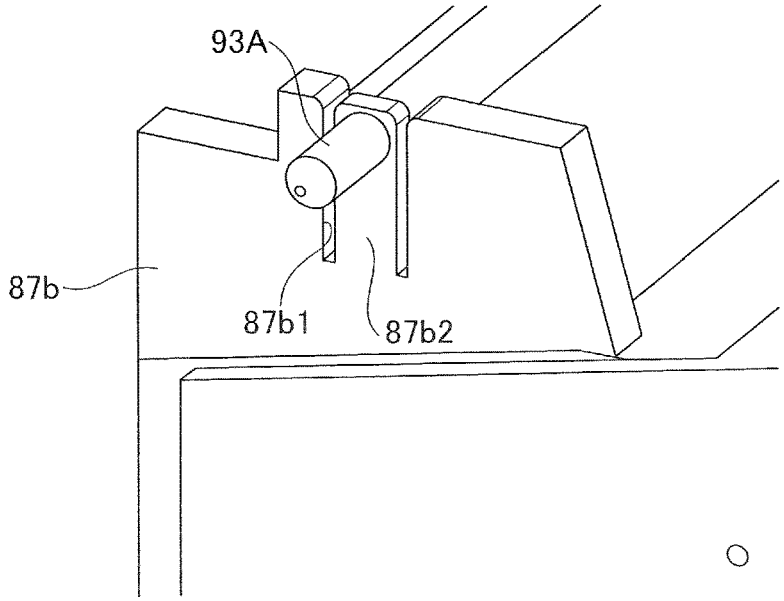
FIG. 18B illustrates a retaining shaft of the second embodiment.
Figure 19A:
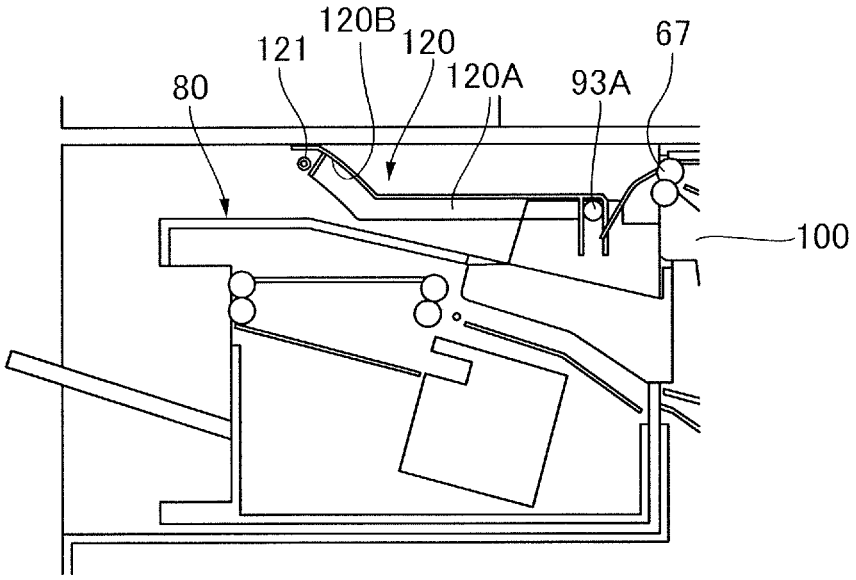
FIG. 19A illustrates the post-processing apparatus located at the operating position.
Figure 19B:
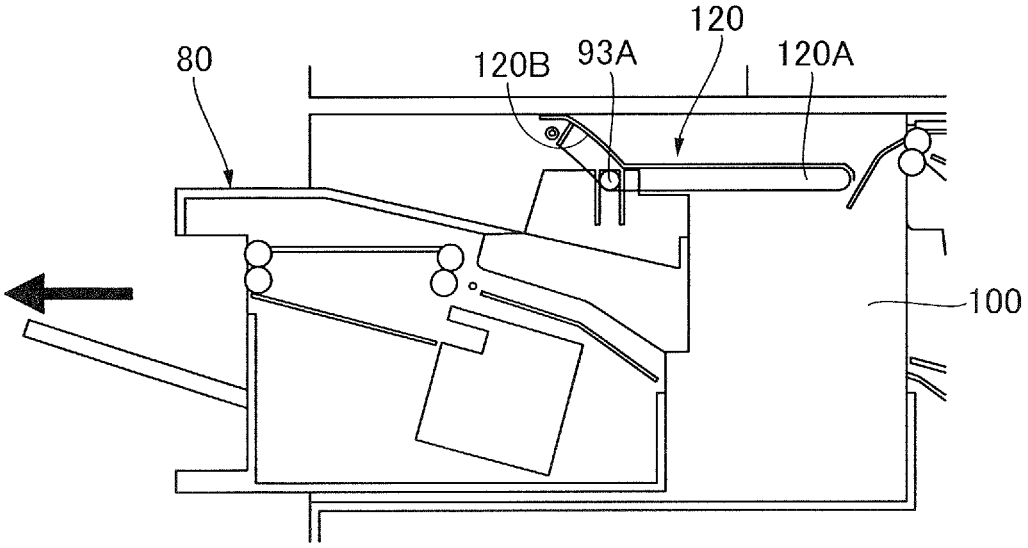
FIG. 19B illustrates the post-processing apparatus on a way of sliding and moving from the operating position to the jam processing position.

As illustrated in FIGS. 18A and 18B, a retaining shaft 93A serving as an abutment member that fits with the retaining hole 121 is provided on a side surface 87*b* of the cover 87 of the post-processing apparatus 80. Defined also on the side surface 87*b* while interposing the retaining shaft 93A is a pair of slits 87*b*1 that is configured such that the retaining shaft 93A deflects when a load of certain degree or more is applied. As illustrated in FIG. 19A, the retaining shaft 93A is positioned at an end on a side of the sheet discharge roller pair 67 of the image forming apparatus body 100 in the straight area 120A of the groove 120 when the post-processing apparatus 80 is located at the operating position. Then, when the post-processing apparatus 80 is moved from the operating position toward the jam processing position, the retaining shaft 93A slides and moves while keeping a tip portion of the retaining shaft 93A in the straight area 120A of the groove 120.

Figure 20A:
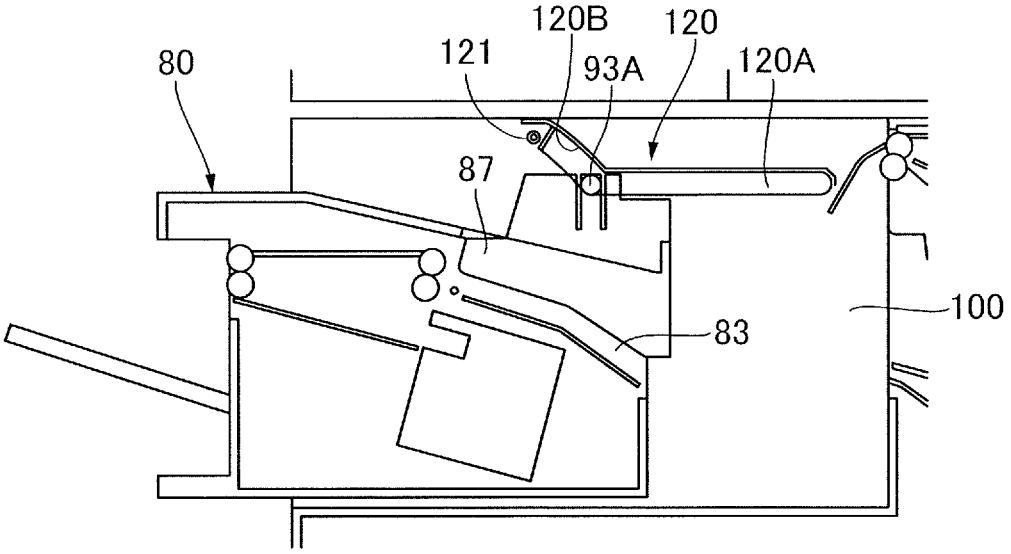
FIG. 20A illustrates the post-processing apparatus that has slid and moved further from the position indicated in FIG. 19B to the jam processing position.
Figure 20B:
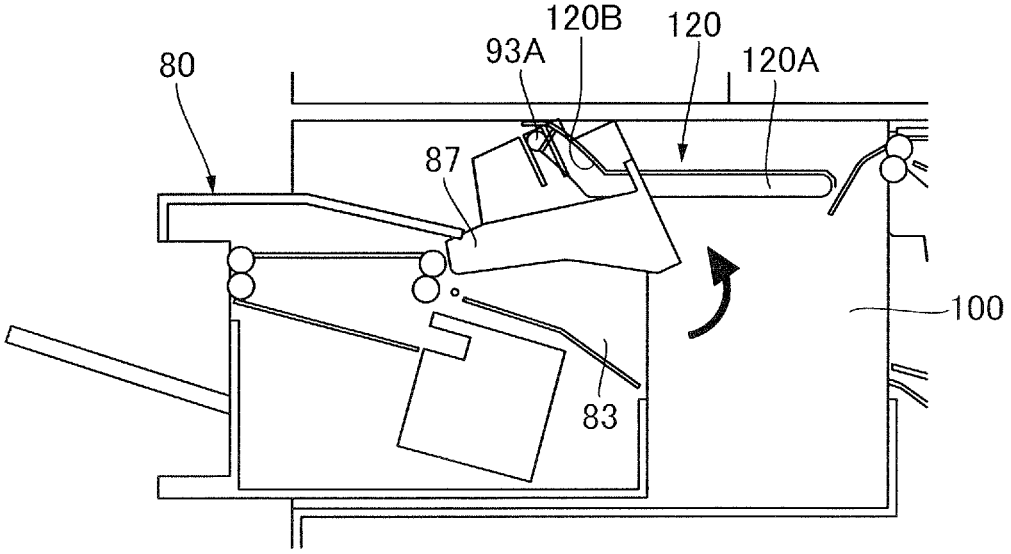
FIG. 20B illustrates the post-processing apparatus in opening the cover at the jam processing position.

When the post-processing apparatus 80 moves toward the jam processing position and the tip of the retaining shaft 93A enters the arcuate area 120B of the groove 120, the retaining shaft 93A is guided upward along the arcuate area 120B and the cover 87 thus starts to pivot. Then, when the post-processing apparatus 80 is slid and moved near the jam processing position, the cover 87 opens until the operator can access the sheet conveyance path 83 as illustrated in FIGS. 20A and 20B. Then, finally, the retaining shaft 93A rides over the parting portion 123 described above and enters the retaining hole 121.

Figure 21A:
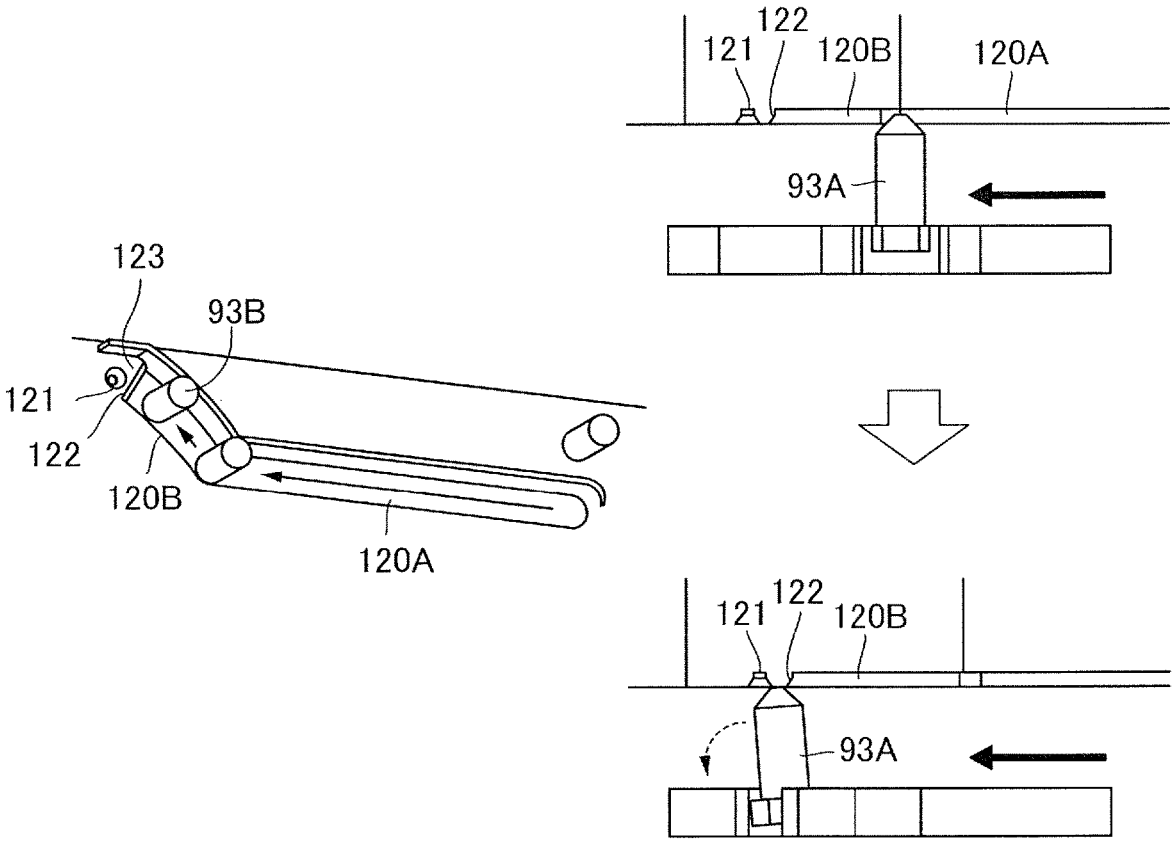
FIG. 21A illustrates a motion of the retaining shaft on a way of sliding and moving the post-processing apparatus from the operating position to the jam processing position.
Figure 21B:
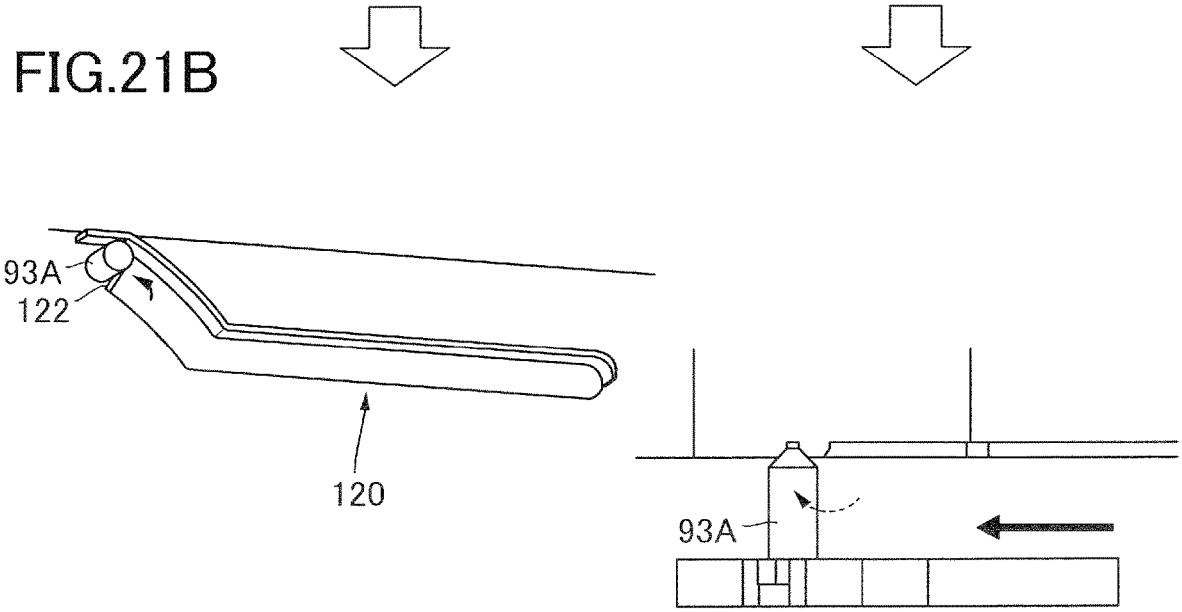
FIG. 21B illustrates the retaining shaft when the post-processing apparatus is located at the jam processing position.

More specifically, the tip of the retaining shaft 93A butts against the slope 122 at the end of the arcuate area 120B of the groove 120 as illustrated in FIG. 21A in a process of pivoting the cover 87 from the close position to the open position. At this time, because a shaft retaining portion 87*b*2 (see FIG. 18B) of the side surface 87*b* parted by the slits 87*b*1 and serving as an elastic member deflects, the retaining shaft 93A is displaced by an external force from the slope 122.

Because the shaft holding portion 87*b*2 deflects and sets back, the retaining shaft 93A rises up the slope 122 and passes through the parting portion 123 between the groove 120 and the retaining hole 121. Then, the deflection of the shaft holding portion 87*b*2 returns to its original state as the retaining shaft 93A fits with the retaining hole 121, and the tip of the retaining shaft 93A enters the retaining hole 121 in a condition of being supported by the retaining hole 121.

Because the retaining shaft 93A is urged by an elastic force of the shaft holding portion 87*b*2 in the same manner with the first embodiment, the cover 87 will not return from the open position to the close position by its own weight. Still further, in a case of pulling out the jammed sheet being nipped by the roller pairs 84 and 85 within the post-processing apparatus 80 while resisting against the nip force, the retaining shaft 93A is urged by the urging force of the shaft holding portion 87*b*2 so as to be able to fully keep the retaining condition of the post-processing apparatus 80.

Figure 22A:
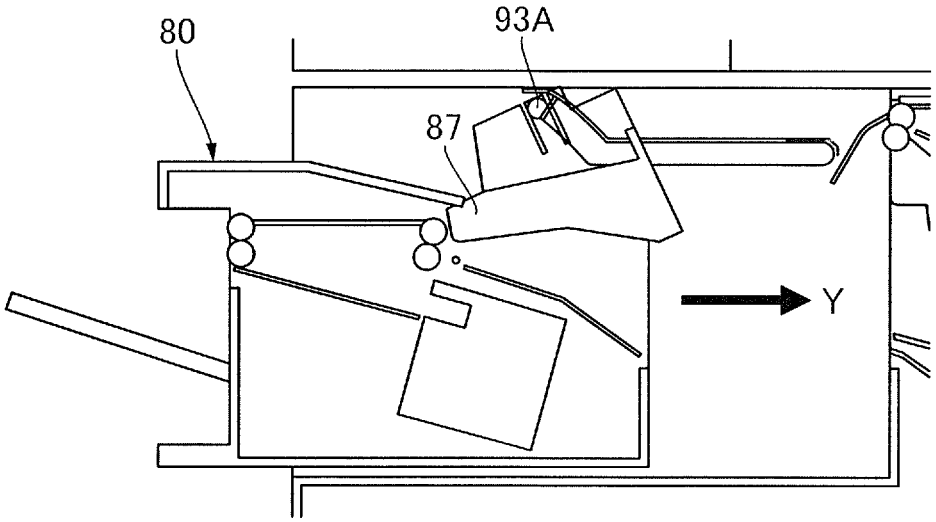
FIG. 22A illustrates the post-processing apparatus in moving from the jam processing position to the operating position.
Figure 22B:
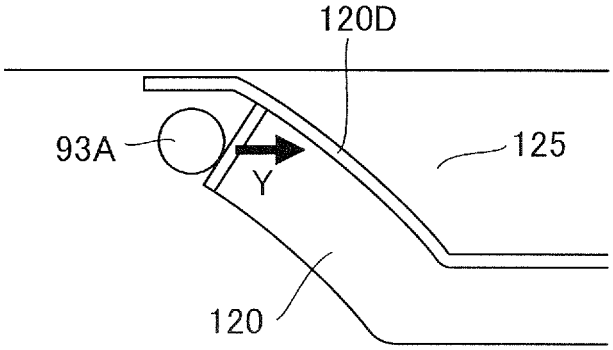
FIG. 22B illustrates the retaining shaft in the condition in FIG. 22A.

Still further, if the post-processing apparatus 80 is caused to slide and move to the operating position in the condition in which the cover 87 is opened and the tip of the retaining shaft 93A fits in the retaining hole 121, the retaining shaft 93A slides and moves in the Y direction together with the post-processing apparatus 80 as illustrated in FIGS. 22A and 22B.

If the retaining shaft 93A slides and moves from this position, the retaining shaft 93A rises up the retaining hole 121 and passes through the parting portion 123 between the groove 120 and the retaining hole 121 as the shaft holding portion 87*b*2 deflects and sets back in the same manner with the motion in opening/closing the cover 87. Then, as the retaining shaft 93A fits in the groove 120, the deflection of the shaft holding portion 87*b*2 returns to its original state and the tip of the retaining shaft 93A enters the groove 120. After that, the retaining shaft 93A is guided along the arcuate area 120B of the groove 120 and the cover 87 is closed as the retaining shaft 93A comes into the straight area 120A.

As described above, according to the present embodiment, the retaining mechanism 90 is consisted of the retaining shaft 93A serving as the projecting portion projecting out of the cover 87 and the retaining hole 121 serving as the recess defined in the image forming apparatus body 100 and fitting with the projecting portion. Then, both of the cover 87 and the post-processing apparatus 80 are retained by arranging such that the retaining shaft 93A fits with the retaining hole 121 at least when the cover 87 is opened in the condition in which the post-processing apparatus 80 is located at the jam processing position.

Note that while the recess is defined on the side of the image forming apparatus body 100 and the projecting portion is provided on the side of the post-processing apparatus 80 in the arrangement of the present embodiment, the recess may be provided on the side of the post-processing apparatus 80 and the projecting portion may be provided on the side of the image forming apparatus body 100. That is, it is also possible to arrange such that one of the first and second engage portions is configured as the projecting portion projecting to the other and the other one of the first and second engage portions is configured as the recess fittable with the projecting portion. Still further, while the retaining mechanism 90 is constituted of both of the slide cam and the retaining shaft as the projecting portion in the first embodiment, the downstream slope of the first embodiment may be defined by a recess for example. Still further, the retaining hole 121 and the groove 120 may be defined continuously unless a detent effect of informing the operator of that the post-processing apparatus 80 is located at the open position by a response is not required.

Still further, while the retaining shaft 93A is displaced by the elastic force of the shaft holding portion 87*b*2 in the second embodiment, it is also possible to arrange such that the retaining shaft is formed of a flexible member or an elastic member such as rubber and is displaced by an elastic force of the retaining shaft itself.

Figure 23A:
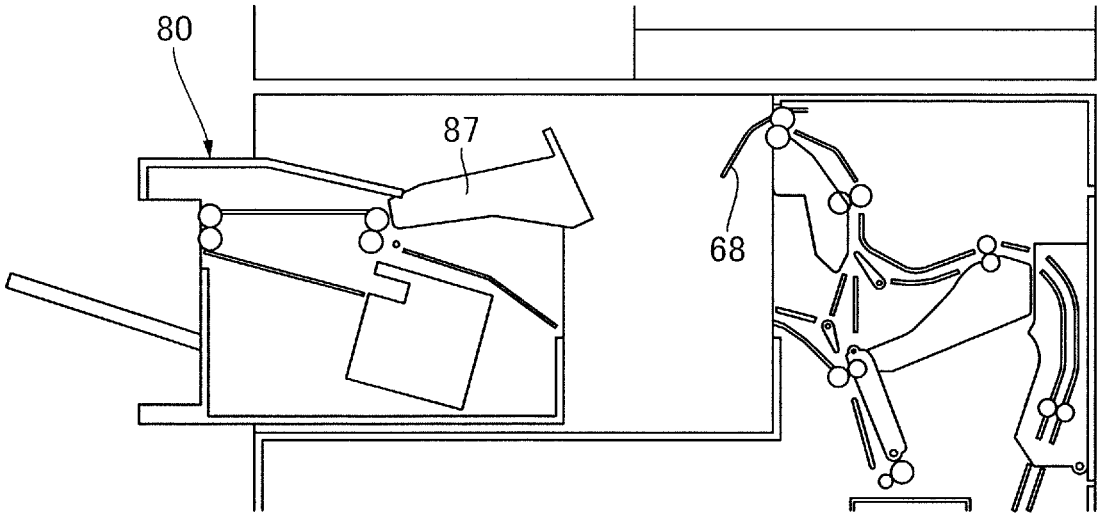
FIG. 23A illustrates the post-processing apparatus located at the jam processing position.
Figure 23B:
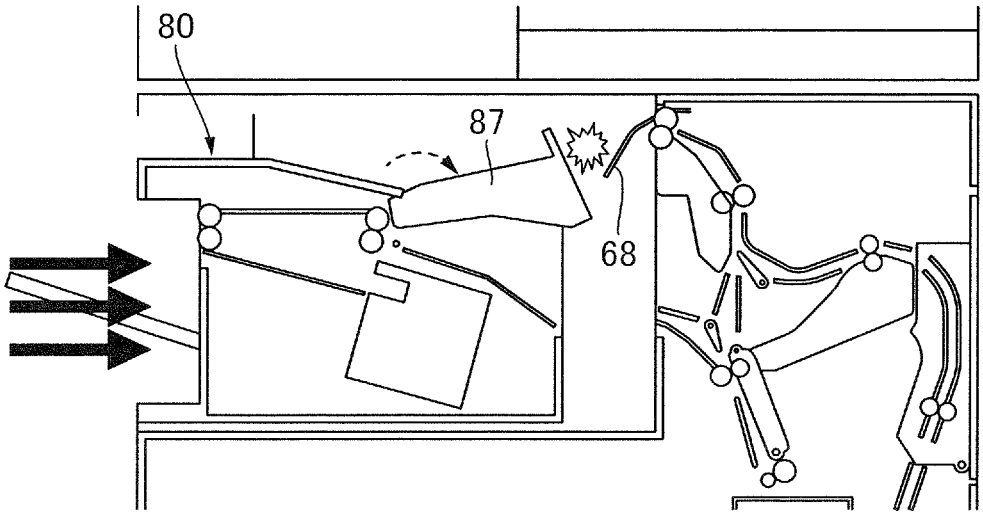
FIG. 23B illustrates a case where the cover collides against a full load detecting flag.

Still further, as illustrated in FIG. 22B, the groove 120 is provided with a regulating surface 120D disposed at an upper surface of the groove 120 along an entire length thereof. Due to that, even if the post-processing apparatus 80 is caused to vigorously slide and move from the jam processing position to the operating position, the regulating surface 120D prevents the retaining shaft 93A from jumping over the groove 120 and being positioned in an opposite area 125. Otherwise, the tip of the retaining shaft 93A cannot enter the groove 120. Accordingly, even if the post-processing apparatus 80 is caused to vigorously slide and move from the jam processing position to the operating position as illustrated in FIGS. 23A and 23B, the post-processing apparatus 80 will not reach the operating position before the cover 87 returns to the close position. Thereby, the cover 87 will not unintentionally collide and destruct the full load detecting flag 68. Still further, the cover 87 will not be erroneously opened, thus causing a jam, during the sheet conveyance operation.

While the regulating surface 120D is an essential component that prevents the retaining shaft 93A from jumping over the groove 120 and from being positioned in the area 125 in the present embodiment, it is also possible to dispose the regulating surface also in the first embodiment. The same effect can be obtained by providing the regulating surface 120D.

Third Embodiment

Next, a third embodiment of the present disclosure will be described with reference to FIGS. 24 through 31. Note that the third embodiment is different from the first embodiment in that the slide cum of the retaining mechanism 90 is formed on a plane of the image forming apparatus body 100 in parallel with moving direction of the post-processing apparatus 80. Therefore, the same components with those of the first embodiment will be denoted by the same reference numerals and a description thereof will be omitted.

Figure 24:
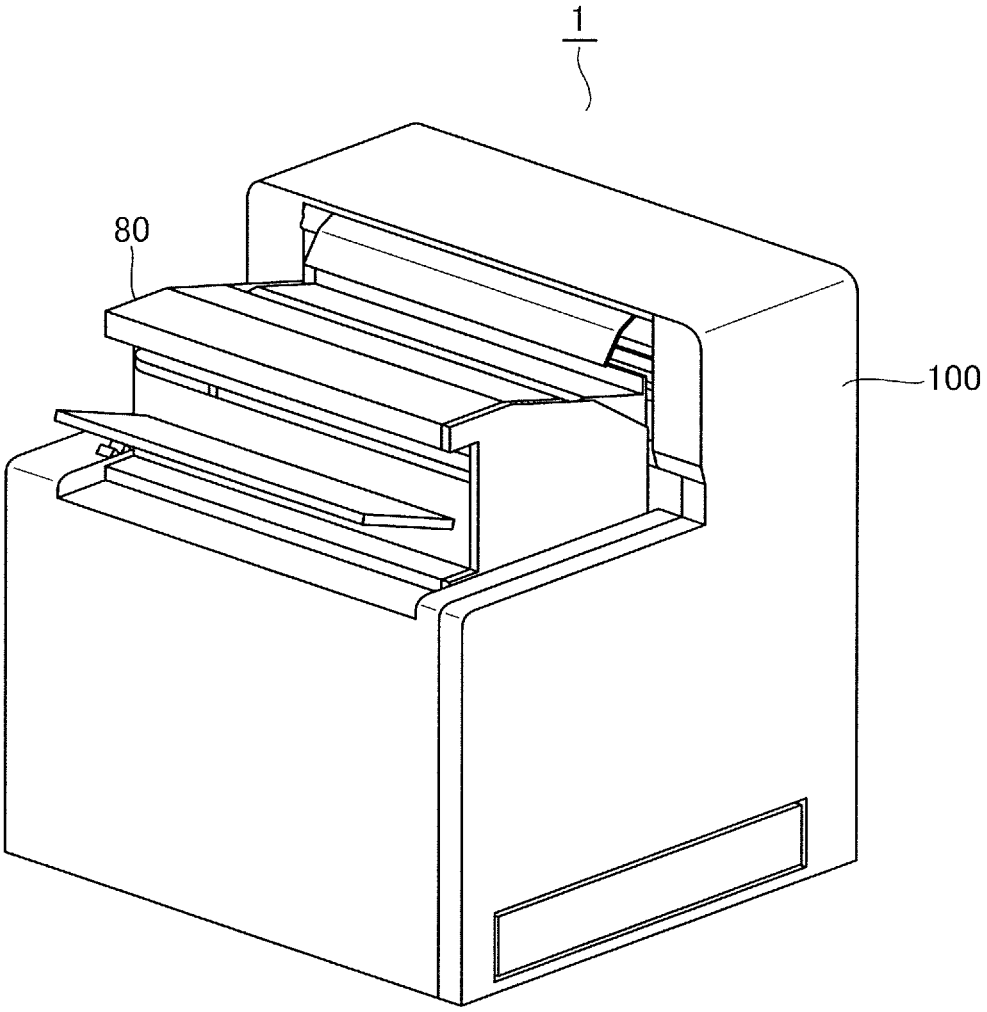
FIG. 24 is a perspective view illustrating an image forming apparatus of a third embodiment.
Figure 25:
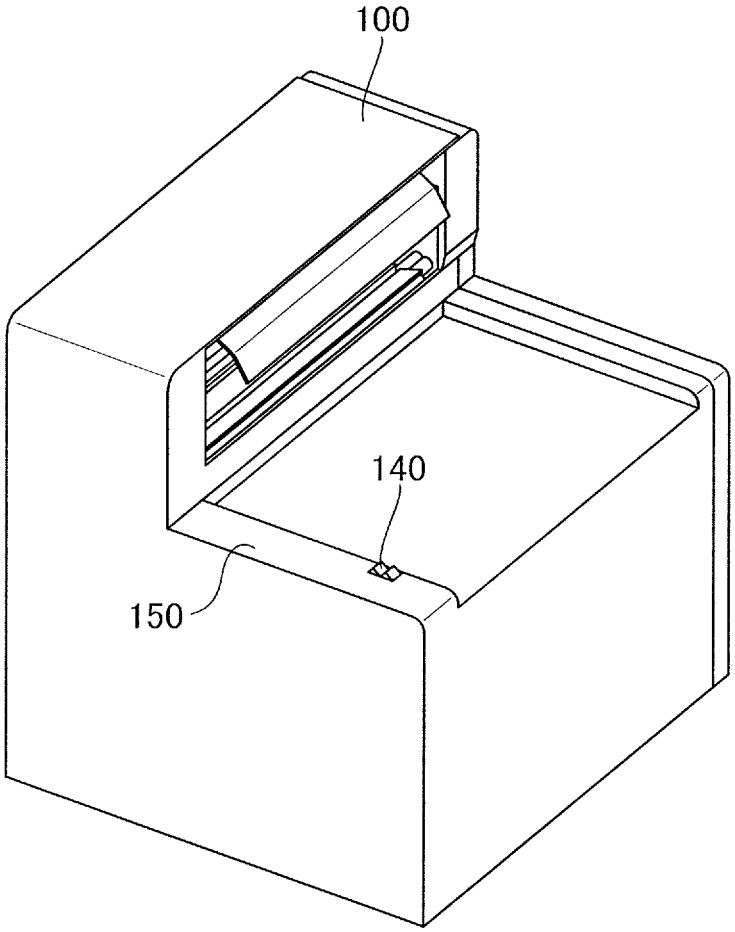
FIG. 25 is a perspective view illustrating the image forming apparatus viewed from a different angle from what in FIG. 24.
Figure 26A:
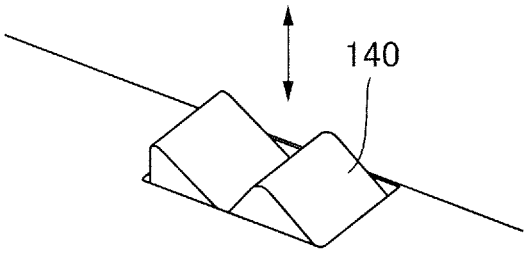
FIG. 26A is a perspective view of the slide cam of the third embodiment.
Figure 26B:
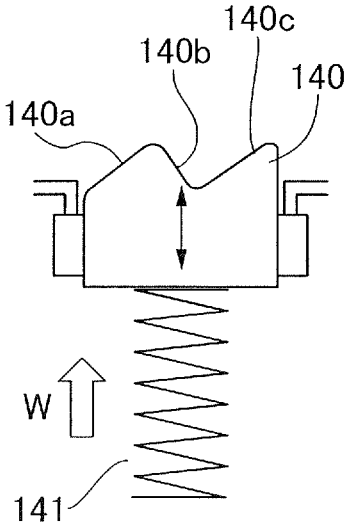
FIG. 26B is a schematic diagram illustrating a configuration of the slide cam in FIG. 26A.

As illustrated in FIG. 24, the printer 1 does not include an image reading unit above the image forming apparatus body 100 and has no side surface of the image forming apparatus body 100 facing the side surface of the post-processing apparatus 80 in the present embodiment. Due to that, as illustrated in FIG. 25, a slide cam 140 is provided within an area 150 where the post-processing apparatus 80 is not disposed within a top surface portion of the image forming apparatus body 100. As illustrated in FIGS. 26A and 26B, the slide cam 140 is arranged to be slidable in a direction of projecting/receding to/from the top surface portion 150 and is urged by an urging member 141 to stand by and to retain at a most projecting position from the top surface.

Figure 27A:
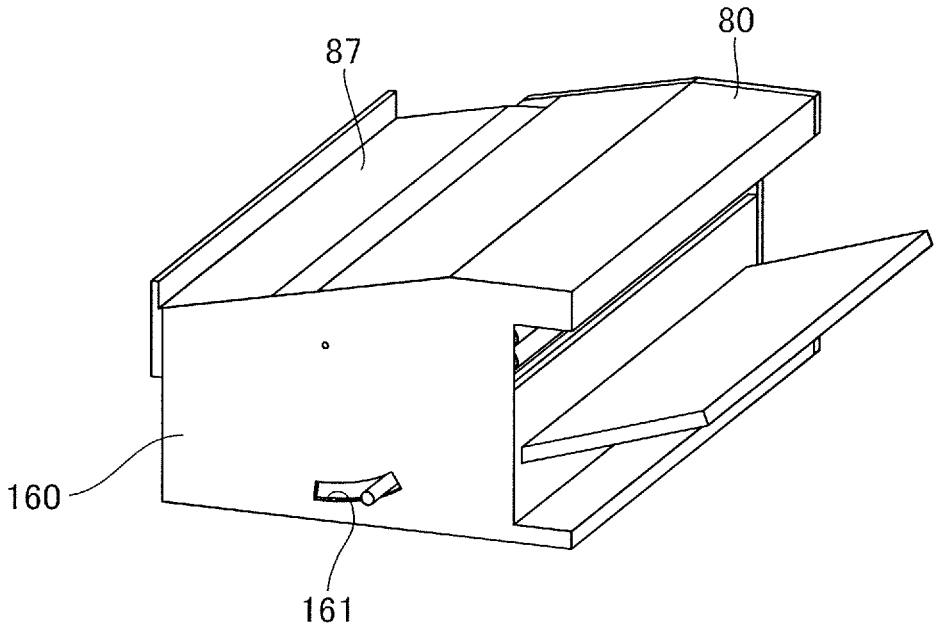
FIG. 27A illustrates a post-processing apparatus according to the third embodiment.
Figure 27B:
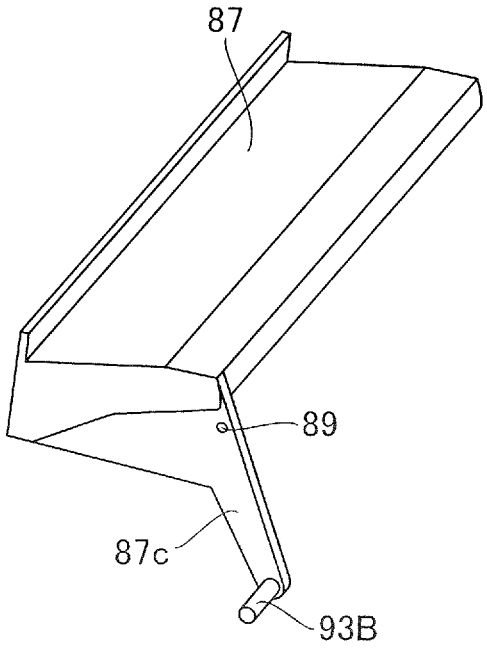
FIG. 27B illustrates a cover of the third embodiment.
Figure 28A:
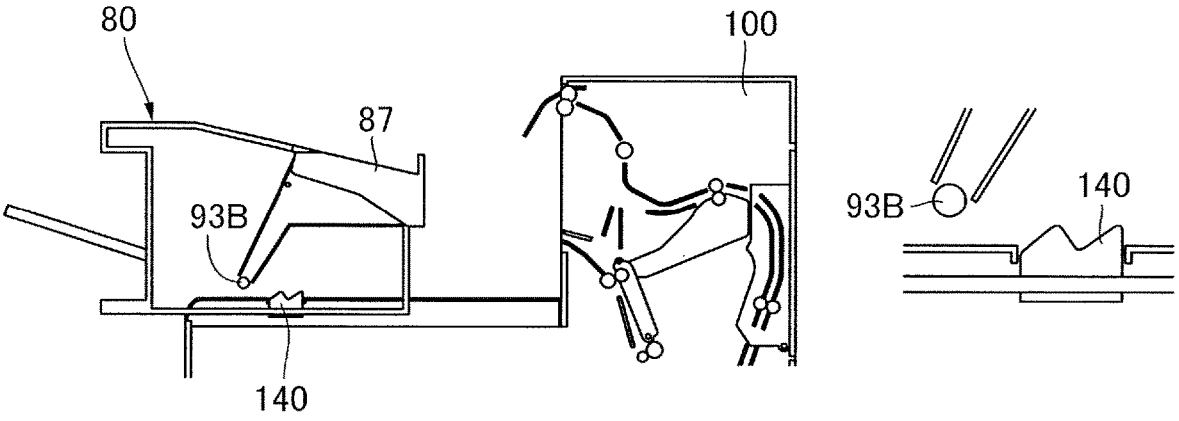
FIG. 28A illustrates a relationship between the slide cam and a retaining shaft in a case where the cover is closed.
Figure 28B:
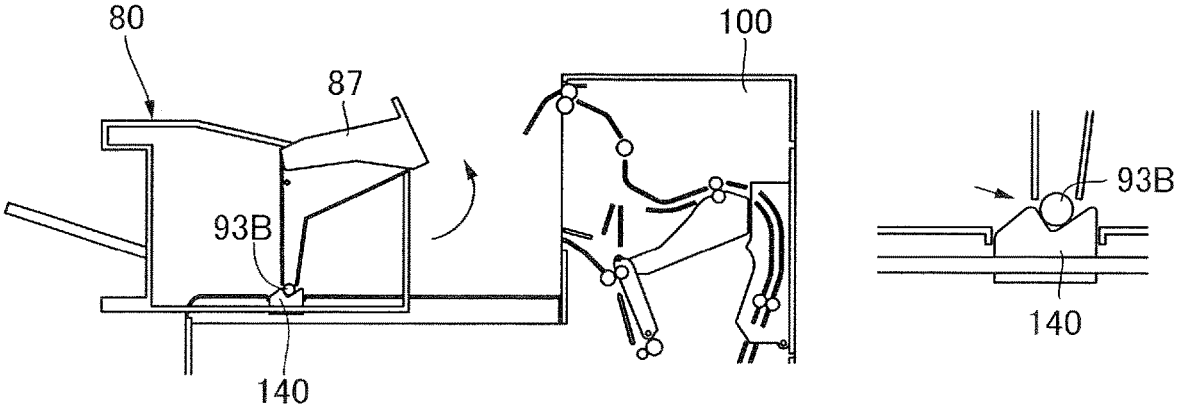
FIG. 28B illustrates the relationship between the slide cam and the retaining shaft in a case where the cover is opened.
Figure 29A:
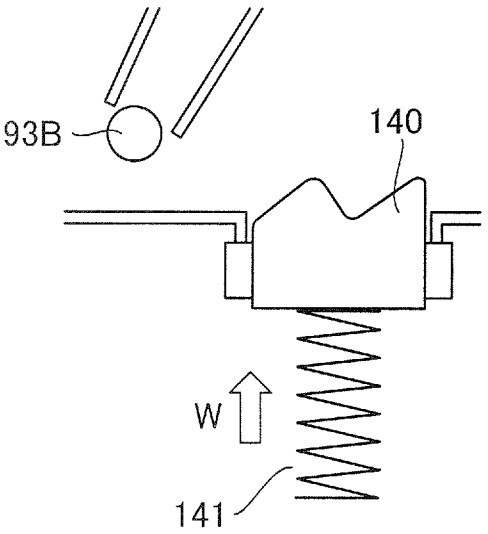
FIG. 29A illustrates the retaining shaft in a case where the cover is closed.
Figure 29B:
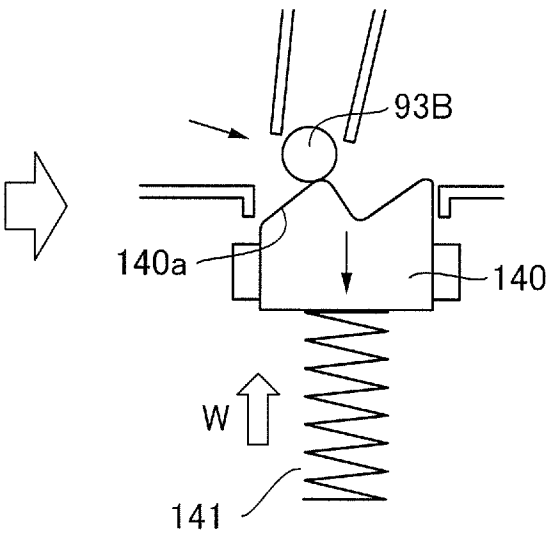
FIG. 29B illustrates the retaining shaft on a way of moving and opening the cover.
Figure 29C:
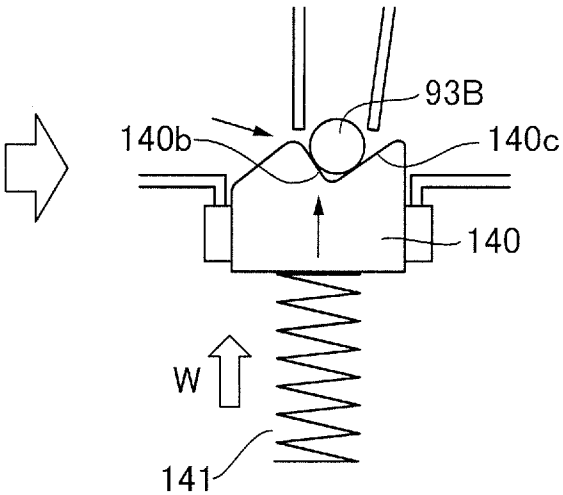
FIG. 29C illustrates the retaining shaft in a case where the cover is opened.

Still further, as illustrated in FIGS. 27A and 27B, the post-processing apparatus 80 of the present embodiment is configured such that the pivotable and openable cover 87 includes an arm 87*c* extending to an opposite side from a body portion of the cover, i.e., downward, in between a pivot shaft 89. In the present embodiment, a retaining shaft 93B is provided so as to project from a tip portion of the arm 87*c*, and a long hole 161 for causing the retaining shaft 93B to project out is defined on a side surface of a body portion of the post-processing apparatus 80.

As illustrated in FIGS. 28A through 29C, the retaining shaft 93B abuts first with a slope 140*a* of the slide cam 140 in a process of pivoting the cover 87 from the close position to the open position. As the retaining shaft 93B moves while abutting with the slope 140*a*, the slide cam 140 slidingly moves inside of the top surface portion 150 while resisting against an urging force W of an urging member 141. Then, when the retaining shaft 93B moves through a tip of the slide cam 140, the slide cam 140 gradually returns to its original standby and holding position by the urging force W of the urging member 141. Then, the retaining shaft 93B comes to a position where the retaining shaft 93B enters a cam surface of the slide cam 140 at the standby and holding position in a stage in which the cover 87 is completely opened and which enables the operator to access the sheet conveyance path 83. The slide cam 140 is applied with an urging force capable of retaining the cover 87 by the urging member 141 such that the cover 87 does not return to its original position by its own weight in the same manner with the first and second embodiment.

The slide cam 140 is also applied with an enough urging force by the urging member 141 that enables to keep the retaining condition of the post-processing apparatus 80 when the sheet S jammed while being nipped by the roller pair within the post-processing apparatus 80 is pulled out by resisting against a nip force.

Figure 30A:
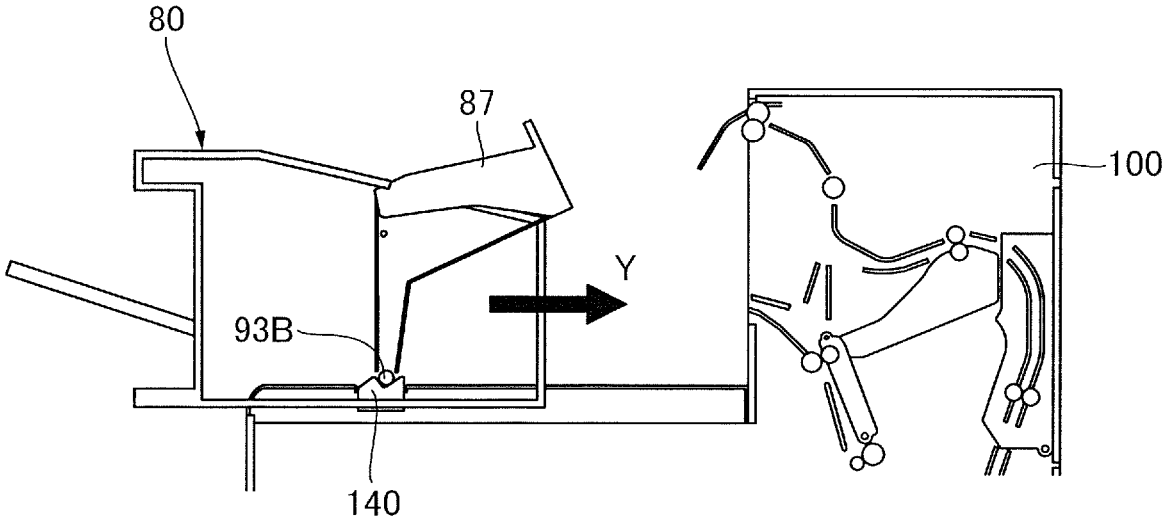
FIG. 30A illustrates the post-processing apparatus in moving from the jam processing position to the operating position in the third embodiment.
Figure 30B:
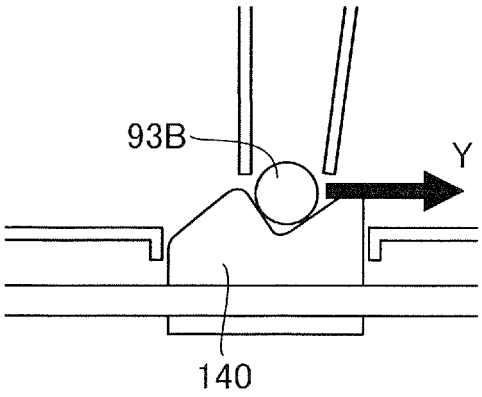
FIG. 30B illustrates the retaining shaft in FIG. 30A.
Figure 31A:
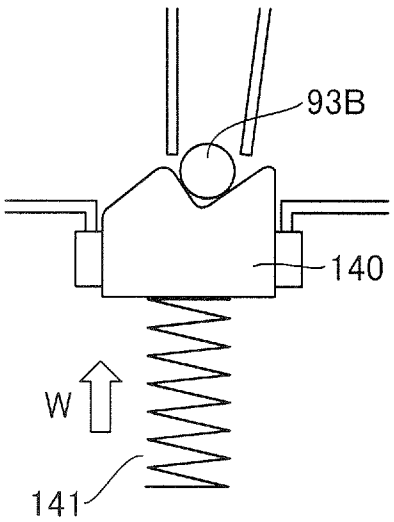
FIG. 31A illustrates the retaining shaft in a case where the post-processing apparatus is located at the jam processing position while opening the cover.
Figure 31B:
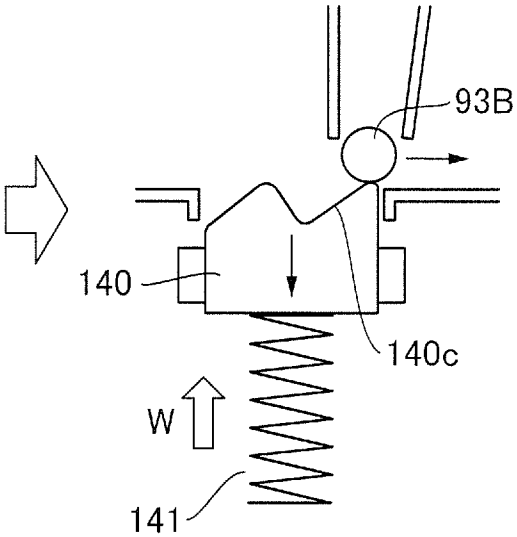
FIG. 31B illustrates the retaining shaft in a case where the post-processing apparatus is moved from the condition in FIG. 31A to the operating position.
Figure 31C:
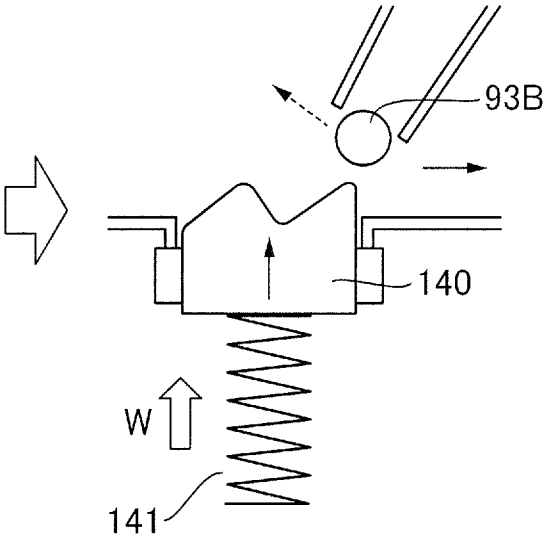
FIG. 31C illustrates the retaining shaft in a case where the post-processing apparatus is moved from the condition in FIG. 31B to the operating position.

If the post-processing apparatus 80 is tried to be slid and moved from the jam processing position to the operating position in the condition in which the cover 87 is opened and the retaining shaft 93B enters the cam surface of the slide cum, i.e., between slopes 140*b* and 140*c*, as illustrated in FIGS. 30A and 30B, the retaining shaft 93B also slides and moves in the Y direction together with the post-processing apparatus 80. If the retaining shaft 93B slides and moves from this position, the retaining shaft 93B moves while abutting with the slope 140*c* and the slide cam 140 slides and moves inside of the top surface portion 150 while resisting against the urging force W of the urging member 141. Then, the slide cam 140 moves inside, the cover 87 returns from the open position to the close position by its own weight because nothing retains the retaining shaft 93B. In the same time, the slide cam 140 returns to its original standby and holding position by the urging force W of the urging member 141.

As described above, the slide cam 140 serving as the first engage portion is provided on the plane of the image forming apparatus body 100 extending in the direction parallel to the moving direction of the post-processing apparatus 80. The urging member 141 serving also as the elastic member urges the slide cam 140 upward and vertically displaceably supports the slide cam 140. The retaining shaft 93B serving as the second engage portion is configured so as to pivot corresponding to the pivot operation of the cover 87 from the close position to the open position and so as to engage with the slide cam 140. This arrangement makes it possible to retain the cover 87 and the post-processing apparatus 80 respectively at the open position and the jam processing position with the simple structure not only in the in-body structure in which the image scanner is disposed in the upper part of the apparatus but also in the structure in which the upper part is opened.

Note that although the configuration of the sheet conveyance apparatus has been described by exemplifying the post-processing apparatus and the body of the image forming apparatus, the present disclosure is not limited to such configuration. For instance, the present disclosure is also applicable to a sheet feeding apparatus including an option feeder and a sheet conveyance apparatus composed of a document feeder and the body of the image forming apparatus. That is, the present disclosure is applicable to any sheet conveyance apparatus as long as positions of two movable members are retained by the retaining portion. Still further, the post-processing portion 82 serving as the sheet processing portion for processing the sheet is not limited to the stapler serving as a staple processing portion for stapling a plurality of sheets and may be structured including a punching portion, a sorting portion or the like for example and may include the plurality of functions. Note that the punching portion described above functions as a punching processing portion configured to perforate a hole through the sheet and the sorting portion described above functions as a sorting processing portion configured to sort discharge destinations of the sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-197899, filed Oct. 19, 2018, which is hereby incorporated by reference herein in its entirety.

What is claimed is:

1. A sheet conveyance apparatus comprising:

a first conveyance unit configured to convey a sheet;

a second conveyance unit comprising a cover movable between a close position at which the cover is positioned when the sheet is conveyed on a sheet conveyance path and an open position at which the cover is positioned when the sheet conveyance path is opened, the second conveyance unit being configured to be movable with respect to the first conveyance unit between a first position where the sheet conveyed from the first conveyance unit can be conveyed to the sheet conveyance path and a second position separated from the first position; and a retaining portion configured to retain the cover at the open position and to retain the second conveyance unit at the second position through the cover retained at the open position in a case where the cover is positioned at the open position in a condition in which the second conveyance unit is positioned at the second position.

2. The sheet conveyance apparatus according to claim 1, wherein the retaining portion comprises a first engage portion provided in the first conveyance unit, a second engage portion provided in the cover and retaining the cover at the open position by engaging with the first engage portion and an elastic member displaceably supporting one of the first and second engage portions, and wherein in a case where the second conveyance unit is moved in a first moving direction from the second position to the first position in a condition in which the cover is retained by the retaining portion, the second conveyance unit moves while displacing one of the first and second engage portions abutted each other by resisting against an elastic force of the elastic member so that the retaining portion apply a resistance to the second conveyance unit.

3. The sheet conveyance apparatus according to claim 2, wherein the first engage portion is provided on a wall surface of the first conveyance unit facing the second conveyance unit and includes a slope inclined such that an upstream side of the slope is located upward of a downstream side of the slope in a second moving direction in which the second conveyance unit moves from the first position to the second position, and wherein, in a case where the cover is positioned at the open position in a condition in which the second conveyance unit is located at the second position, the slope is configured to be positioned upstream of the second engage portion in the second moving direction and to abut with the second engage portion from downward of the second engage portion.

4. The sheet conveyance apparatus according to claim 2, wherein one of the first and second engage portions is a projecting portion projecting toward the other one of the first and second engage portions and the other one of the first and second engage portions is a recess into which the projecting portion fits, and wherein the projecting portion and the recess are configured such that the projecting portion fits into the recess at least when the cover is positioned at the open position in a condition in which the second conveyance unit is positioned at the second position.

5. The sheet conveyance apparatus according to claim 2, wherein the first engage portion is provided on a plane of the first conveyance unit extending in a direction in parallel with a moving direction of the second conveyance unit and the elastic member urges upward and vertically displaceably supports the first engage portion, and wherein the second engage portion is configured to pivot corresponding to a pivot operation of the cover from the close position to the open position and engage with the first engage portion.

6. The sheet conveyance apparatus according to claim 1, wherein the retaining portion comprises a first engage portion provided on the first conveyance unit and a second engage portion provided on the cover and engageable with the first engage portion, and wherein the first engage portion comprises a support portion configured to support the second engage portion from downward in a gravity direction and a resistance applying portion configured to abut with the second engage portion and apply a resistance to the second conveyance unit in a case where the second conveyance unit moves from the second position to the first position.

7. The sheet conveyance apparatus according to claim 1, wherein the retaining portion is configured to release a retainment of the cover and the second conveyance unit if the second conveyance unit moves from the second position toward the first position by a predetermined distance or more.

8. The sheet conveyance apparatus according to claim 1, wherein, in a case where the second conveyance unit is located at the second position, the retaining portion is configured to retain the second conveyance unit at the second position if the cover is positioned at the open position and not to retain the second conveyance unit at the second position if the cover is positioned at the close position.

9. The sheet conveyance apparatus according to claim 1, wherein the second conveyance unit comprises a sheet processing portion configured to process the sheet, the sheet processing portion comprising at least one of a staple processing portion configured to staple a plurality of sheets conveyed by the first conveyance unit, a punch processing portion configured to perforate a hole through the sheet and a sorting processing portion configured to sort a discharge destination of the sheet.

10. An image forming apparatus comprising:

the sheet conveyance apparatus as set forth in claim 1; and an image forming unit configured to form an image on a sheet.

11. The image forming apparatus according to claim 10, wherein the second conveyance unit is disposed above the image forming unit and at a position where at least a part thereof overlaps with the image forming unit when viewed in a perpendicular direction.

12. The image forming apparatus according to claim 10, further comprising an image reading unit disposed above the image forming unit and reading an image of a document, wherein the second conveyance unit is disposed in a space between the image forming unit and the image reading unit.

* * * * *